US009122223B2

(12) United States Patent
Kato

(10) Patent No.: US 9,122,223 B2
(45) Date of Patent: Sep. 1, 2015

(54) DRIVING APPARATUS, IMAGE FORMING APPARATUS, DRIVING METHOD AND IMAGE FORMING METHOD

(71) Applicant: Oki Data Corporation, Tokyo (JP)

(72) Inventor: Koji Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/132,787

(22) Filed: Dec. 18, 2013

(65) Prior Publication Data

US 2014/0178102 A1 Jun. 26, 2014

(30) Foreign Application Priority Data

Dec. 21, 2012 (JP) ..... 2012-278807

(51) Int. Cl.
*G03G 15/00* (2006.01)
*G03G 15/16* (2006.01)
*G03G 15/01* (2006.01)

(52) U.S. Cl.
CPC ..... *G03G 15/757* (2013.01); *G03G 15/0189* (2013.01); *G03G 15/1615* (2013.01); *G03G 15/505* (2013.01); *G03G 15/5008* (2013.01); *G03G 15/5054* (2013.01); *G03G 2215/0158* (2013.01)

(58) Field of Classification Search
CPC ..... G03G 15/757; G03G 15/1615; G03G 15/5008; G03G 15/0189; G03G 15/505; G03G 15/5054; G03G 2215/0158
USPC ..... 399/66, 167, 299, 300, 302, 303, 306, 399/308
See application file for complete search history.

(56) References Cited

U.S. PATENT DOCUMENTS

| | | | | |
|---|---|---|---|---|
| 5,950,052 | A * | 9/1999 | Nomura et al. | 399/167 |
| 6,633,737 | B1 * | 10/2003 | Tanaka et al. | 399/66 |
| 2003/0095815 | A1 * | 5/2003 | Nakagawa et al. | 399/299 |
| 2008/0080881 | A1 * | 4/2008 | Inoue | 399/50 |
| 2011/0097112 | A1 * | 4/2011 | Kim et al. | 399/167 |
| 2012/0003010 | A1 * | 1/2012 | Birumachi | 399/167 |
| 2012/0045249 | A1 * | 2/2012 | Koizumi | 399/167 |
| 2014/0099135 | A1 * | 4/2014 | Hiratsuka et al. | 399/66 |

FOREIGN PATENT DOCUMENTS

| | | | |
|---|---|---|---|
| JP | H11-191989 | A | 7/1999 |
| JP | 2008-083232 | A | 4/2008 |
| JP | 2010-231048 | A | 10/2010 |

* cited by examiner

*Primary Examiner* — Ryan Walsh
(74) *Attorney, Agent, or Firm* — Rabin & Berdo, P.C.

(57) ABSTRACT

An driving apparatus includes a plurality of image bearing bodies each of which is rotatable and capable of bearing a latent image and a developer image, a rotatable belt provided so as to face the image bearing bodies, a plurality of image-bearing-body-driving units for rotating the image bearing bodies, a belt driving unit for rotating the belt, and a control unit. The control unit causes the image-bearing-body-driving units and the belt driving unit to start rotating the image bearing bodies and the belt so that the image bearing bodies and the belt rotate at a first speed. When the control unit detects that the image bearing bodies and the belt rotate at the first speed, the control unit causes the image-bearing-body-driving units and the belt driving unit to accelerate rotation speeds of the image bearing bodies and the belt to a second speed faster than the first speed.

10 Claims, 11 Drawing Sheets

BRAKE SIGNAL S41a
H
L

FREQUENCY OF CLOCK SIGNAL S41b
0
50PPM

ROTATION SPEED
0
50PPM

LOCK SIGNAL S51c
H
L

CURRENT VALUE OF POWER SOURCE UNIT
0
T1
T2
T3
TIME

BRAKE SIGNAL S41a
H
L

FREQUENCY OF CLOCK SIGNAL S41b
0
13PPM
16PPM

ROTATION SPEED
0
13PPM
16PPM

LOCK SIGNAL S51c
H
L

CURRENT VALUE OF POWER SOURCE UNIT
0
T1
T2
T3
T4
T5
TIME

47K S41a

47C S41a

62C

47M S41a

62M

47Y S41a

62Y

47W S41a

62W

46 S41a

47K S51c

47C S51c

47M S51c

47Y S51c

47W S51c

46 S51c

GROUP-D S41b
22ppm

GROUP-E S41b
ΔT1
50ppm
13ppm

CURRENT VALUE OF POWER SOURCE
T61
T62
T63
T64
T65
TIME

FIG. 10A 47K S41a
FIG. 10B 47C S41a
FIG. 10C 47M S41a
FIG. 10D 47YS41a
FIG. 10E 47W S41a
FIG. 10F 46 S41a
FIG. 10G 47K S51c
FIG. 10H 47C S51c
FIG. 10I 47M S51c
FIG. 10J 47Y S51c
FIG. 10K 47W S51c
FIG. 10L 46 S51c
FIG. 10M S41c
ΔT1
ΔT2 ΔT3 ΔT4 ΔT5 ΔT6 ΔT7 ΔT8
FIG. 10N GROUP-A S41b
13ppm
22ppm
27ppm
40ppm
50ppm
FIG. 10O GROUP-B S41b
13ppm
22ppm
32ppm
45ppm
50ppm
FIG. 10P GROUP-C S41b
13ppm
22ppm
35ppm
50ppm
FIG. 10Q CURRENT VALUE OF POWER SOURCE
T81 T82 T83 T84 T85 T86 T87 T88 T89 T810 T811 T812
TIME

DRIVING APPARATUS, IMAGE FORMING APPARATUS, DRIVING METHOD AND IMAGE FORMING METHOD

BACKGROUND OF THE INVENTION

The present invention relates to a driving apparatus using a motor or the like, an image forming apparatus using the driving apparatus, a driving method using the driving apparatus, and an image forming method using the image forming apparatus.

There is an image forming apparatus including a plurality of image forming units and a belt that moves along the image forming units. The image forming units respectively include image bearing bodies (i.e., photosensitive drums) provided so as to contact the belt. The image bearing bodies are driven by direct current motors (i.e., ID motors). The belt is driven by another direct current motor (i.e., a belt motor). The belt motor and the ID motors are driven in synchronization with each other. Such an image forming apparatus is disclosed by, for example, Japanese Laid-open Patent Publication No. 2008-83232.

In the conventional art, peak current applied to the belt motor and the drum motors becomes relatively large.

SUMMARY OF THE INVENTION

An aspect of the present invention is intended to provide a driving apparatus, an image forming apparatus, a driving method and an image forming apparatus capable of reducing peak current.

According to an aspect of the present invention, there is provided a driving apparatus including a plurality of image bearing bodies each of which is rotatable and capable of bearing a latent image and a developer image, a belt provided so as to face the image bearing bodies, the belt being rotatable, a plurality of image-bearing-body-driving units for rotating the image bearing bodies, a belt driving unit for rotating the belt, and a control unit for controlling the image-bearing-body-driving units and the belt driving unit. The control unit causes the image-bearing-body-driving units and the belt driving unit to start rotating the image bearing bodies and the belt so that the image bearing bodies and the belt rotate at a first speed. When the control unit detects that the image bearing bodies and the belt rotate at the first speed, the control unit causes the image-bearing-body-driving units and the belt driving unit to accelerate rotation speeds of the image bearing bodies and the belt to a second speed faster than the first speed.

With such a configuration, peak current for driving the image-bearing-body-driving units and the belt driving unit can be reduced.

According to another aspect of the present invention, there is provided an image forming apparatus including the above described driving apparatus, developing units configured to form developer images on the image bearing bodies, transfer units configured to transfer the developer images from the image bearing bodies to a recording medium directly or via the belt, and a fixing unit that fixes the developer image to the recording medium.

According to still another aspect of the present invention, there is provided a driving method using the above described driving apparatus. The driving method includes starting the image-bearing-body driving unit and the belt driving unit so that the image bearing bodies and the belt rotate at the first speed, detecting whether the image bearing bodies and the belt rotate at the first speed, and causing the image-bearing-body driving unit and the belt driving unit to accelerate the rotation speeds of the image bearing bodies and the belt to the second speed.

According to yet another aspect of the present invention, there is provided an image forming method using the above described image forming apparatus. The image forming method includes starting the image-bearing-body driving unit and the belt driving unit so that the image bearing bodies and the belt rotate at the first speed, detecting whether the image bearing bodies and the belt rotate at the first speed, causing the image-bearing-body driving unit and the belt driving unit to accelerate the rotation speeds of the image bearing bodies and the belt to the second speed, forming developer images on the image bearing bodies, transferring the developer images from the image bearing bodies to the recording medium, and fixing the developer images to the recording medium.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, a belt unit and an image forming apparatus according to embodiments of the present invention will be described with reference to drawings.

Embodiment 1

Configuration of Embodiment 1

Figure 1:
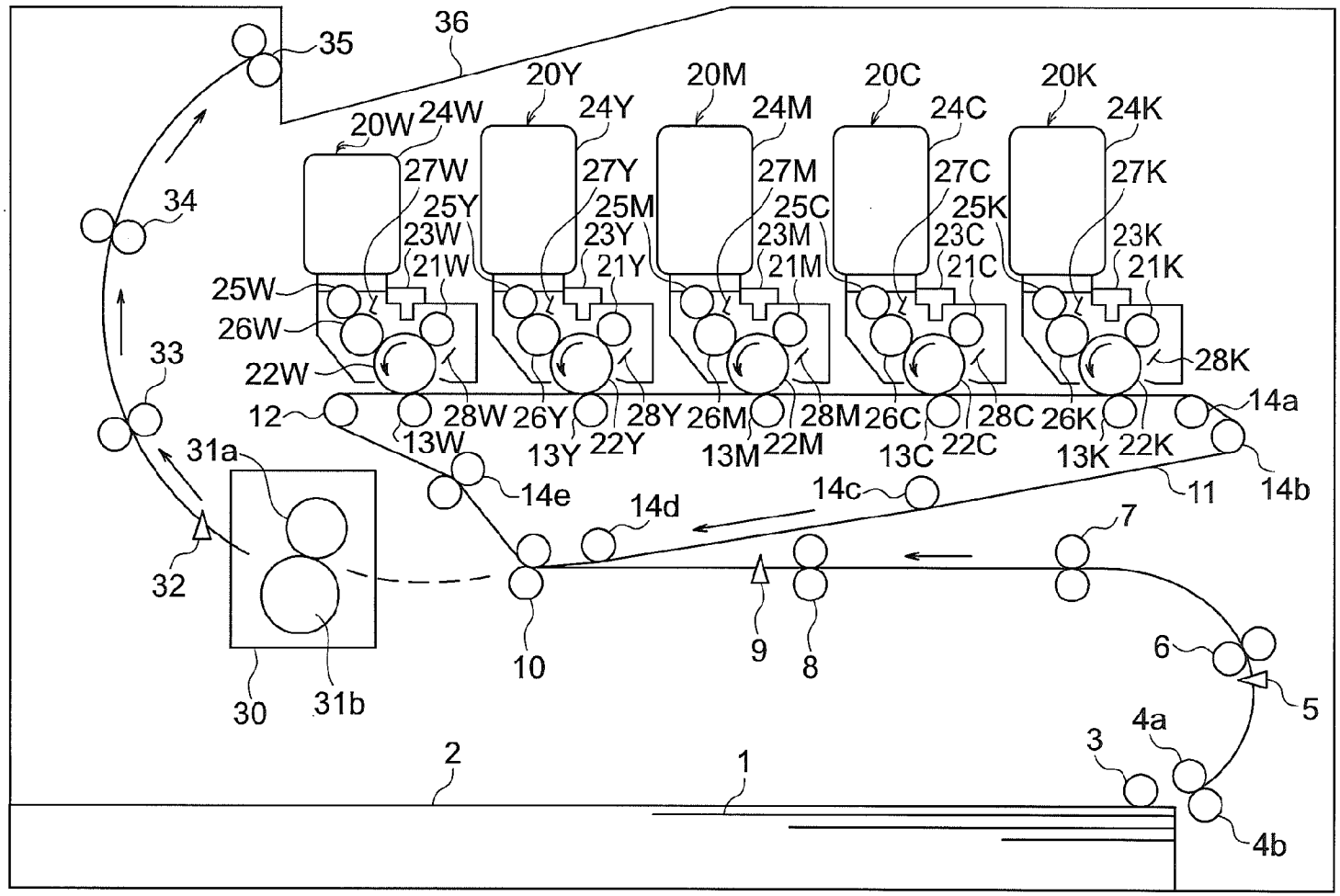
FIG. 1 is a schematic sectional view showing a configuration of an image forming apparatus according to Embodiment 1 of the present invention.

FIG. 1 is a perspective view showing a configuration of an image forming apparatus according to Embodiment 1.

The image forming apparatus is configured as, for example, a color printer of an intermediate transfer type. A medium cassette 2 (i.e., a medium storage portion) is provided on a lower part of the image forming apparatus. The medium cassette 2 is configured to store a stack of a plurality of recording media (i.e., printing sheets). A pickup roller 3 is provided so as to contact an uppermost recording medium 1 stored in the medium cassette 2. The pickup roller 3 rotates to feed the recording medium 1 out of the medium cassette 2. A feed roller 4*a* and a retard roller 4*b* are provided in the vicinity of the pickup roller 3. The feed roller 4*a* and the retard roller 4*b* feed the recording media 1 separately one by one into a feeding path.

An entrance sensor 5 is provided at an entrance of the feeding path of the recording medium 1. The entrance sensor 5 is configured to detect a leading edge and a trailing edge of the recording medium 1. The entrance sensor 5 can also detect presence/absence of the recording medium 1. The entrance sensor 5 is, for example, a photo-interrupter. The photo-interrupter includes a photo coupler (i.e., a light emitting element and a light receiving element) and a lever rotated by being pushed by the recording medium 1. The lever rotates to interrupt or transmit a light of a light path of the photo coupler. A pair of first conveying rollers 6 are provided downstream of the entrance sensor 5. The first conveying rollers 6 start rotating when a certain time period expires after the leading edge of the recording medium 1 reaches a nip portion of the first conveying rollers 6, so as to correct skew of the recording medium 1. A pair of second conveying rollers 7 and a pair of timing rollers 8 are provided downstream of the first conveying rollers 6.

A writing sensor 9 is provided downstream of (and in the vicinity of) the timing rollers 8. The writing sensor 9 is configured to detect the leading edge of the recording medium 1 having passed through the timing rollers 8. Detection signal of the writing sensor 9 is used to determine a timing to start image formation. The detection signal of the writing sensor 9 is also used to change a rotation speed of the timing rollers 8 so as to align a position of the recording medium 1 with respect to the image on a belt 11 (described later). The writing sensor 9 is, for example, a photo-interrupter like the entrance sensor 5. The writing sensor 9 can also detect presence/absence of the recording medium 1. A secondary transfer rollers 10 (i.e., a secondary transfer unit) are provided downstream of the writing sensor 9.

ID (Image Drum) units 20W, 20Y, 20M, 20C and 20K are provided on an upper part of the image forming apparatus. The ID units 20W, 20Y, 20M, 20C and 20K are arranged from downstream to upstream (left to right in FIG. 1) along a rotating direction of the belt 11. The ID units 20W, 20Y, 20M, 20C and 20K are collectively referred to as the "ID units 20". The ID units 20W, 20Y, 20M, 20C and 20K are configured to form developer images (i.e., toner images) of white (W), yellow (Y), magenta (M), cyan (C) and black (K) on the belt 11.

The ID units 20W, 20Y, 20M, 20C and 20K include photosensitive drums 22W, 22Y, 22M, 22C and 22K as image bearing bodies. The photosensitive drums 22W, 22Y, 22M, 22C and 22K are collectively referred to as the photosensitive drum 22. The photosensitive drum 22 is configured to bear a latent image, and also bear a developer image (i.e., a toner image).

The ID units 20W, 20Y, 20M, 20C and 20K further include charging rollers 21W, 21Y, 21M, 21C and 21K, LED (Light Emitting Diode) heads 23W, 23Y, 23M, 23C and 23K, developer cartridges 24W, 24Y, 24M, 24C and 24K, developer supplying rollers 25W, 25Y, 25M, 25C and 25K, developing rollers 26W, 26Y, 26M, 26C and 26K, developing blades 27W, 27Y, 27M, 27C and 27K, and cleaning blades 28W, 28Y, 28M, 28C and 28K.

The charging rollers 21W, 21Y, 21M, 21C and 21K (i.e., charging members) are configured to supply electric charge to the photosensitive drums 22K, 22Y, 22M, 22C and 22K to uniformly charge the surfaces of the photosensitive drums 22K, 22Y, 22M, 22C and 22K. The charging rollers 21W, 21Y, 21M, 21C and 21K are collectively referred to as the charging rollers 21. The photosensitive drums 22K, 22Y, 22M, 22C and 22K rotate counterclockwise carrying the electric charge. The LED heads (i.e., exposure units) 23W, 23Y, 23M, 23C and 23K are located above the photosensitive drum 22W, 22Y, 22M, 22C and 22K. The LED heads 23W, 23Y, 23M, 23C and 23K emit light so as to expose the surfaces of the photosensitive drums 22W, 22Y, 22M, 22C and 22K to form latent images thereon. The LED heads 23W, 23Y, 23M, 23C and 23K are collectively referred to as the LED heads 23. The developer cartridges (i.e., developer storage bodies) 24W, 24Y, 24M, 24C and 24K are configured to store developers (i.e., toners) of white, yellow, magenta cyan and black. The developer cartridges 24W, 24Y, 24M, 24C and 24K are correctively referred to as the developer cartridges 24. The developer supplying rollers (i.e., developer supplying members) 25W, 25Y, 25M, 25C and 25K are configured to supply the developers supplied from the developer cartridges 24W, 24Y, 24M, 24C and 24K to the developing rollers 26W, 26Y, 26M, 26C and 26K. The developer supplying rollers 25W, 25Y, 25M, 25C and 25K are collectively referred to as the developer supplying rollers 25.

The developing blades (i.e., developer regulating members) 27W, 27Y, 27M, 27C and 27K are configured to regulate thicknesses of developer layers on the developing rollers 26W, 26Y, 26M, 26C and 26K. The developing blades 27W, 27Y, 27M, 27C and 27K are correctively referred to as the developing blades 27. The developing rollers (i.e., developing units or developer bearing bodies) 26W, 26Y, 26M, 26C and 26K are configured to cause the developers to adhere to the latent images on the photosensitive drums 22W, 22Y, 22M, 22C and 22K so as to develop the latent images (i.e., to form developer images). The developing rollers 26W, 26Y, 26M, 26C and 26K are collectively referred to as the developing rollers 26. The developer images are transferred to the belt 11 at nip portions between the photosensitive drums 22W, 22Y, 22M, 22C and 22K and transfer rollers 13W, 13Y, 13M, 13C and 13K described later.

The cleaning blades (i.e., cleaning members) 28W, 28Y, 28M, 28C and 28K are configured to remove the developers that remain on the surfaces of the photosensitive drums 22W, 22Y, 22M, 22C and 22K after the developer images are transferred to the belt 11. The cleaning blades 28W, 28Y, 28M, 28C and 28K are collectively referred to as the cleaning blades 28.

Primary transfer rollers (i.e., primary transfer units) 13W, 13Y, 13M, 13C and 13K are provided so as to face the photosensitive drums 22W, 22Y, 22M, 22C and 22K via the belt 11. The primary transfer rollers 13W, 13Y, 13M, 13C and 13K are configured to primarily transfer the developer images from the photosensitive drum 22W, 22Y, 22M, 22C and 22K to the belt 11 using a high voltage (i.e., a primary transfer voltage). The primary transfer rollers 13W, 13Y, 13M, 13C and 13K are collectively referred to as the primary transfer rollers 13. The primary transfer rollers (i.e., primary transfer members) 13W, 13Y, 13M, 13C and 13K and the secondary transfer rollers 10 constitute a transfer unit.

The belt 11 (i.e., an intermediate transfer belt) is provided in a region between the ID units 20 (20W, 20Y, 20M, 20C and 20K) and the feeding path of the recording medium 1 (along the second conveying rollers 7, the timing rollers 8, the writing sensor 9 and the like). The belt 11 is driven to rotate clockwise in FIG. 1. The belt 11 bears the developer image transferred from the ID units 20, and carries the developer image to the secondary transfer rollers 10.

The belt 11 is held by the secondary transfer rollers 10, a belt roller 12, the primary transfer rollers 13W, 13Y, 13M, 13C and 13K, and belt rollers 14*a*, 14*b*, 14*c*, 14*d* and 14*e*. The belt 11 is driven by the belt roller 12 to rotate as shown by an arrow A contacting the photosensitive drums 22W, 22Y, 22M, 22C and 22K.

As the belt 11 rotates, the developer image primarily transferred to the belt 11 reaches the secondary transfer rollers 10. The secondary transfer rollers 10 are applied with a high voltage (i.e., a secondary transfer voltage), and transfer the developer image from the belt 11 to the recording medium 1.

A fixing unit 30 is provided downstream of the secondary transfer rollers 10. The fixing unit 30 includes a fixing roller 31*a* and a pressure roller 31*b* that fix the developer image to the recording medium 1 by applying heat and pressure. An ejection sensor 32 is provided downstream of the fixing unit 30. The ejection sensor 32 is configured to detect the leading edge and the trailing edge of the recording medium 1 passing the fixing unit 30. The ejection sensor 23 can also detect the presence/absence of the recording medium 1. The ejection sensor 32 is, for example, a photo-interrupter like the entrance sensor 5.

Ejection rollers 33, 34 and 35 are provided downstream of the ejection sensor 32. The ejection rollers 33, 34 and 35 eject the recording medium 1 outside the image forming apparatus. The ejected recording medium 1 is placed on an ejection portion 36 provided on an upper cover of the image forming apparatus.

Figure 2:
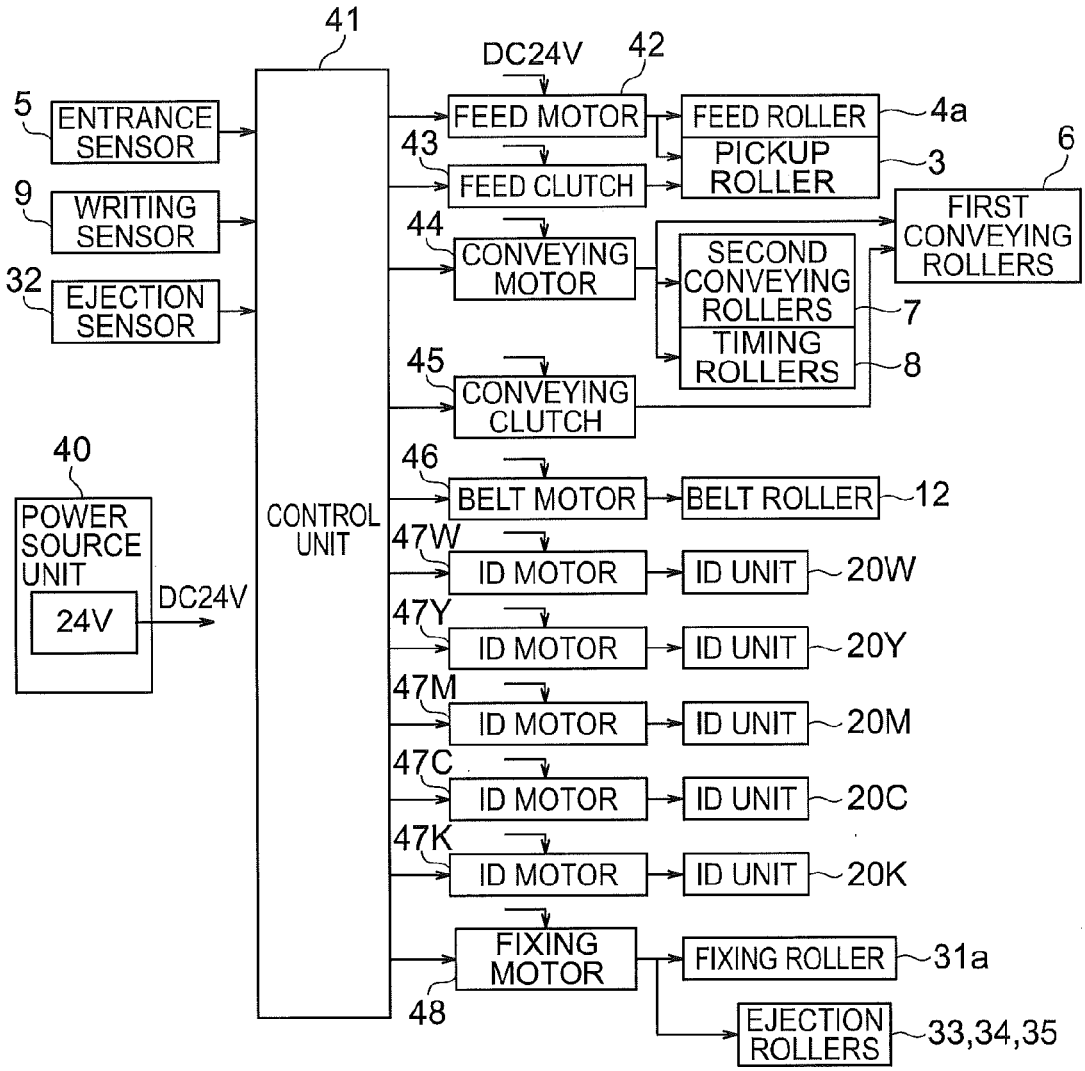
FIG. 2 is a block diagram showing a belt motor of a driving apparatus according to Embodiment 1 of the present invention.

FIG. 2 is a block diagram showing a driving apparatus of the image forming apparatus according to Embodiment 1 of the present invention.

The driving apparatus includes a power source unit 40 and a control unit 41. The power source unit 40 is configure to supply DC (direct current) voltage of 24V to motors including a belt motor 46 and ID motors 47W, 47Y, 47M, 47C and 47K. The control unit 41 is configured to control the motors including the belt motor 46 and the ID motors 47W, 47Y, 47M, 47C and 47K.

The control unit 41 is connected to the entrance sensor 5, the writing sensor 9 and the ejection sensor 32. The control unit 41 is connected to a feed motor 42. The feed motor 42 is constituted by, for example, a stepping motor. A rotation speed of the feed motor 42 is controlled by a frequency of pulse signal sent from the control unit 41. The feed motor 42 is connected to the pickup roller 3 and the feed roller 4*a* via gears. The control unit 41 is connected to a feed clutch 43. The feed clutch 43 is connected to the pickup roller 3. When the feed motor 42 starts rotating in a state where the feed clutch 43 is ON (i.e., engaged), the pickup roller 3 starts rotating to feed the recording medium 1 separately into the feeding path.

The control unit 41 is connected to a conveying motor 44. The conveying motor 44 is connected to the first conveying rollers 6, the second conveying rollers 7 and the timing rollers 8. The control unit 41 is connected to a conveying clutch 45. The conveying clutch 45 is connected to the first conveying rollers 6. When the conveying motor 44 starts rotating while the conveying clutch 45 is. ON (i.e., engaged), the first conveying rollers 6 start rotating. The second conveying rollers 7 and the timing rollers 8 are driven by the conveying motor 44.

The control unit 41 is connected to the belt motor 46 (i.e., a belt driving unit). The belt motor 46 is constituted by, for example, a brushless DC motor. A rotation speed (i.e., a number of revolutions) of the belt motor 46 is determined by a frequency of clock signal CK sent from the control unit 41. Start and stop of the belt motor 46 is controlled by brake signal BK sent from the control unit 41. The belt motor 46 is connected to the belt roller 12 via gears.

The control unit 41 is connected to ID (Image Drum) motors. 47W, 47Y, 47M, 47C and 47K (i.e., image-bearing-body-driving units). The ID motor 47W, 47Y, 47M, 47C and 47K are respectively connected to the photosensitive drums 22W, 22Y, 22M, 22C and 22K of the ID units 20W, 20Y, 20M, 20C and 20K. The ID motors 47W, 47Y, 47M, 47C and 47K are collectively referred to as the ID motors 47. Each ID motor 47 is constituted by, for example, a brushless DC motor. A rotation speed of the ID motor 47 is determined by a frequency of clock signal CK sent from the control unit 41. Start and stop of the ID motor 47 is controlled by brake signal BK sent from the control unit 41.

The control unit 41 is connected to a fixing motor 48. The fixing motor 48 is constituted by, for example, a brushless DC motor. The fixing motor 48 is connected to the fixing roller 31*a* and the ejection rollers 33, 34 and 35 via gears. A rotation speed of the fixing motor 48 is determined by a frequency of clock signal CK sent from the control unit 41. Start and stop of the fixing motor 48 is controlled by brake signal BK sent from the control unit 41.

Figure 3:
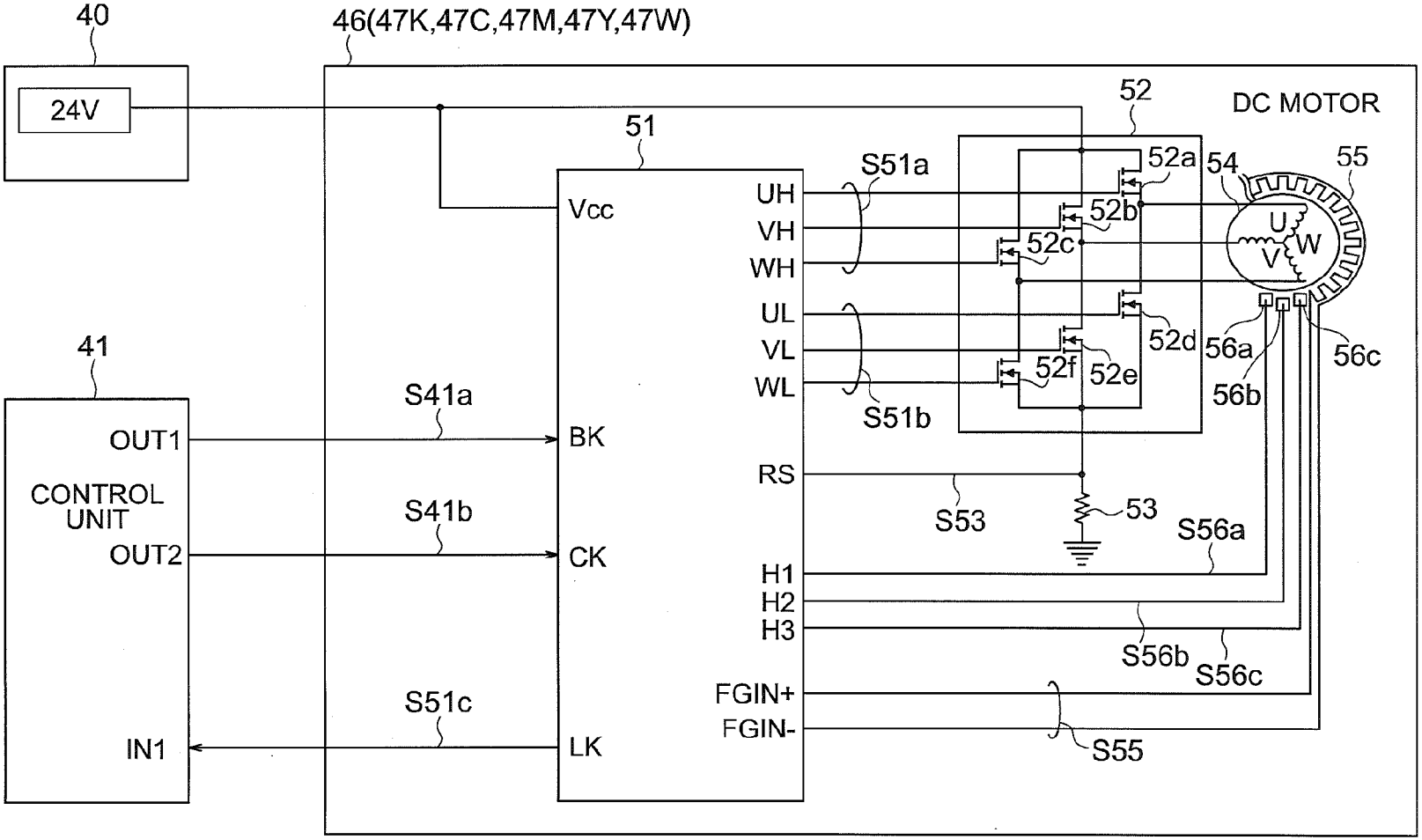
FIG. 3 is a block diagram showing a driving apparatus according to Embodiment 1 of the present invention.

FIG. 3 is a block diagram showing the belt motor 46 of the driving apparatus of Embodiment 1. The belt motor 46 and the ID motors 47W, 47Y, 47M, 47C and 47K have the same configurations. Therefore, the configurations of the belt motor 46 and the ID motors 47W, 47Y, 47M, 47C and 47K will be described taking an example of the belt motor 46. It is also possible that the fixing motor 48 has the same configuration as that shown in FIG. 3.

The belt motor 46 includes a motor control IC (Integrated Circuit) 51, a power MOSFET (Power-Metal-Oxide-Semiconductor Field-Effect Transistor) array 52, and a DC motor 54. The belt motor 46 is supplied with a DC voltage of 24V (i.e., a motor driving voltage) by the power source unit 40. The DC voltage of 24V is inputted into the motor control IC 51 and the power MOSFET array 52. The motor control IC 51 is a control circuit for controlling the DC motor 54. The DC voltage of 24V supplied by the power source unit 40 is inputted into a power source terminal Vcc of the motor control IC 51, and provides a power for the motor control IC 51.

The power MOSFET array 52 has 6 N-channel MOSFETs 52*a*, 52*b*, 52*c*, 52*d*, 52*e* and 52*f*. The N-channel MOSFETs 52*a*, 52*b*, 52*c*, 52*d*, 52*e* and 52*f* includes high-side FETs 52*a*, 52*b* and 52*c* and low-side FETs 52*d*, 52*e* and 52*f*.

The control unit 41 has an output port OUT1, and outputs brake signal S41*a* from the output port OUT1. The outputted brake signal S41*a* is inputted into an input terminal BK of the motor control IC 51. When the brake signal S41*a* is in a high lever (hereinafter, H-level), the motor control IC 51 stops the DC motor 54 by turning ON the low-side FETs 52*d*, 52*e* and 52*f* (i.e., short-brake). When the brake signal S41*a* is in a low level (hereinafter, L-level), the motor control IC 51 drives the DC Motor 54 to rotate.

The control unit 41 has an output port OUT2, and outputs clock signal S41*b* from the output port OUT2. The outputted clock signal S41*b* is inputted into an input terminal CK of the motor control IC 51. When the brake signal S41*a* is in the L-level, the DC motor 54 is driven to rotate at a rotation speed corresponding to the frequency of the clock signal S41*b*.

The control unit 41 has an input port IN1, and receives lock signal S51*c* outputted from the output terminal LK of the motor control IC 51.

The motor control IC 51 has output terminals UH, VH and WH, and outputs high-side gate signals S51*a* (S51*a*-1, S51*a*-2 and S51*a*-3) respectively from the output terminals UH, VH and WH. The high-side gate signals S51*a*-1, S51*a*-2 and S51*a*-3 are inputted into gate terminals of the high-side FETs 52*a*, 52*b* and 52*c*.

The motor control IC 51 has output terminals UL, VL and WL, and outputs low-side gate signals S51*b* (S51*b*-1, S51*b*-2 and S51*b*-3) respectively from the output terminals UL, VL and WL. The low-side gate signals S51*b*-1, S51*b*-2 and S51*b*-3 are inputted into gate terminals of the low-side FETs 52*d*, 52*e* and 52*f*.

A source terminal of the low-side FETs 52*d*, 52*e* and 52*f* of the power MOSFET array 52 is grounded via a current detection resistance 53. Current detection signal S53 from the current detection resistance 53 is inputted into an input terminal RS of the motor control IC 51.

Output terminals of the power MOSFET array 52 are connected to coils of the DC motor 54 (i.e., the brushless DC motor). The DC motor 54 has coils of U-phase, V-phase and W-phase which are connected by star connection. The DC motor 54 has an outer rotor having a not shown permanent magnet.

A coil pattern 55 is provided in the vicinity of the outer rotor of the DC motor 54. The coil pattern 55 is a copper foil pattern in the form of a rectangular wave. The coil pattern 55 generates an electromotive force having a frequency corresponding to a rotation speed of the DC motor 54. This electromotive force (having the frequency corresponding to the rotation speed of the DC motor 54) is referred to as FG (Frequency Generator) pulse signal S55. The FG pulse signal S55 is inputted into input terminals FGIN+ and FGIN− of the motor control IC 51. A predetermined number of pulses of the FG pulse signal S55 are generated by one a rotation of the DC motor 54.

Hall elements 56*a*, 56*b* and 56*c* are provided in the vicinity of the DC motor 54. The Hall elements 56*a*, 56*b* and 56*c* output Hall signals S56*a*, S56*b* and S56*c*. The Hall elements 56*a*, 56*b* and 56*c* are arranged so as to detect switching of polarity of the outer rotor. The Hall elements 56*a*, 56*b* and 56*c* are arranged so that a zero-crossing of outputs of the Hall elements 56*a*, 56*b* and 56*c* occurs when the excited phase is switched. Hall signals S56*a*, S56*b* and S56*c* are respectively inputted into input terminals H1, H2 and H3 of the motor control IC 51.

The motor control IC 51 performs a PWM (Pulse Width Modulation) control of a current applied to the coils of the DC motor 54 by controlling duties of the signals S51*a* and S51*b* supplied to the power MOSFET array 52. Further, the motor control IC 51 controls currents applied to the coils of the DC motor 54 so as to make a frequency of the FG pulse signal S55 equal to the frequency of the inputted clock signal S41*b* using a phase lock loop (PLL). Therefore, the rotation speed of the DC motor 54 is controlled by the frequency of the clock signal S41*b*.

When a difference between the frequency of the FG pulse signal S55 and the frequency of the clock signal S41*b* is greater than ±6%, the motor control IC 51 outputs the lock signal S51*c* of the H-level. When a difference between the frequency of the FG pulse signal S55 and the frequency of the clock signal S41*b* is smaller than ±6%, the motor control IC 51 outputs the lock signal S51*c* of the L-level. When the control unit 41 receives the lock signal S51*c* of the L-level, the control unit 41 judges that the DC motor 54 rotates at a certain rotation speed as instructed.

The motor control IC 51 has a circuit having a current limit function to bring the high-side FETs 52*a*, 52*b* and 53*c* to an OFF state when the current detection signal S53 becomes greater than a threshold (for example, 0.25V). While the DC motor 54 is started and accelerated, a current limit value is maintained by the current limit function. After the DC motor 54 reaches a predetermined rotation speed, the current value decreases.

Operation of Embodiment 1

Next, an operation of the image forming apparatus of Embodiment 1 will be described. (I) First, an entire operation of the image forming apparatus will be described. (II) Next, driving timings of a comparison example will be described. (III) Then, a relationship between the brake signal and the rotation speed of the DC motor 54 of Embodiment 1 will be described. (IV) Then, driving timings of the driving apparatus of Embodiment 1 will be described. (V) Finally, a driving method for starting and accelerating the belt motor 46 (and the ID motors 47W, 47Y, 47M, 47C and 47K) of Embodiment 1 will be described.

[I] Entire Operation

Referring to FIG. 2, according to a user's operation of an operation unit (not shown), the control unit 41 receives an instruction to start image formation. The control unit 41 drives the feed motor 42, the conveying motor 44, the belt motor 46, the ID motors 47W, 47Y, 47M, 47C and 47K and the fixing motor 48. Referring to FIG. 1, when the motors 42, 44, 46 through 48 are driven, the feed roller 4*a*, the first conveying rollers 6, the second conveying rollers 7, the timing rollers 8, the secondary transfer rollers 10, the belt roller 12, the ID units 20W, 20Y, 20M, 20C and 20K (i.e., photosensitive drums 22 and respective rollers), the fixing roller 31*a* and the ejection rollers 33, 34 and 35 are driven to rotate.

When the control unit 41 turns ON the feed clutch 43, the pickup roller 3 rotates and feeds the recording medium 1 out of the medium cassette 2 into the feeding path. Further, by action of the feed roller 4*a* and the retard roller 4*b*, the recording medium 1 is separately fed along the feeding path toward the entrance sensor 5. The recording medium 1 is further conveyed by the first conveying rollers 6, the second conveying rollers 7 and the timing rollers 8 along the feeding path toward the secondary transfer rollers 10 through the writing sensor 9.

When the belt motor 46 is driven, the belt roller 12 is driven to rotate clockwise in FIG. 1, and the belt 11 starts rotating clockwise in FIG. 1. When the rotating speed of the belt 11 reaches a predetermined rotation speed (i.e., an image-formation rotation speed), developer images on the photosensitive drums 22W, 22Y, 22M, 22C and 22K are primarily transferred to the belt 11 in this order. The image-formation rotation speed is set to, for example, 50 pages per minute (PPM). In other words, developer images are printed on 50 recording media (50 pages) of A4 size per 1 minute.

As the belt 11 rotates clockwise, the developer image transferred to the belt 11 moves toward the secondary transfer rollers 10. The writing sensor 9 detects the leading edge of the recording medium 1 having passed the timing rollers 8. Based on the detection signal from the writing sensor 9, a timing when the recording medium 1 reaches the secondary transfer rollers 10 and a timing when the developer image on the belt 11 reaches the secondary transfer rollers 10 are made the same as each other. At the secondary transfer rollers 10, the developer image is secondarily transferred from the belt 11 to the recording medium 1.

The recording medium 1 to which the developer image has been transferred is further' conveyed by the rotation of the secondary transfer rollers 10 and reaches the fixing unit 30. In the fixing unit 30, the fixing roller 31*a* and the pressure roller 31*b* fix the developer image to the recording medium 1 by applying heat and pressure. The recording medium 1 (to which the developer image is fixed) is further conveyed by the fixing roller 31*a*, and is ejected by the ejection rollers 33, 34 and 35. The recording medium 1 passes the ejection sensor 32, and is ejected to the ejection portion 36.

[II] Driving Timings of Comparison Example

Figures 4A, 4B, 4C, 4D, 4E:
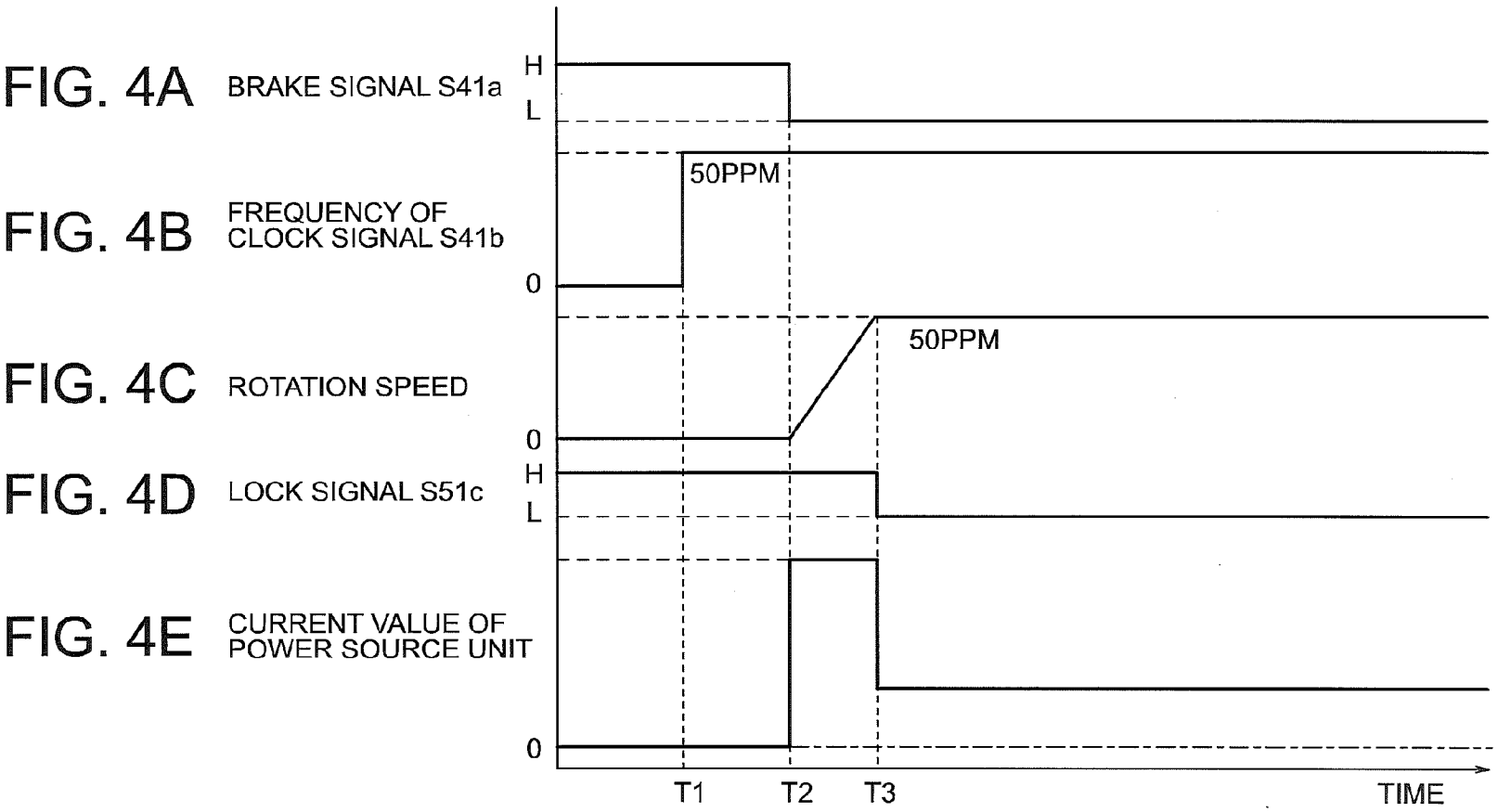
FIGS. 4A, 4B, 4C, 4D and 4E are timing charts respectively showing brake signal, frequency of clock signal, a rotation speed of a DC motor, lock signal and a current value of a power source unit according to a comparison example.

FIGS. 4A, 4B, 4C, 4D and 4E are timing charts showing driving timings of a driving apparatus of a comparison example. FIG. 4A shows the brake signal S41*a*. FIG. 4B shows the frequency of the clock signal 41*b*. FIG. 4C shows the rotation speed (PPM) of the belt motor 46 (and the rotation speed of the ID motors 47K, 47C, 47M, 47W and 47W). FIG. 4D shows the lock signal S51*c*. FIG. 4E shows the current value (A) supplied by the power source unit 40.

In the driving apparatus of the comparison example, at a time T1, the frequency of the clock signal S41*b* (for the belt motor 46 and the ID motors 47K, 47C, 47M, 47Y and 47W) is switched from 0 to a frequency corresponding to 50 PPM (i.e., a setting frequency during image formation) as shown in FIG. 4B, while the brake signal 41*a* for the belt motor 46 and the ID motors 47K, 47C, 47M, 47Y and 47W is kept in the H-level (FIG. 4A).

At a time T2, the brake signal 41*a* for the belt motor 46 and the ID motors 47K, 47C, 47M, 47Y and 47W is switched from the H-level to the L-level as shown in FIG. 4A. As the brake signal 41*a* is switched from the H-level to the L-level, the belt motor 46 and the ID motors 47K, 47C, 47M, 47Y and 47W start rotating, and the rotation speeds of the belt motor 46 and the ID motors 47K, 47C, 47M, 47Y and 47W are accelerated form 0 to 50 PPM (i.e., a printing speed) as shown in FIG. 4C. At a time T3, the rotation speeds reach 50 PPM, and the lock signal S51*c* changes from the H-level to the L-level as shown in FIG. 4D. From the time T3, the rotation speeds of the belt motor 46 and the ID motors 47K, 47C, 47M, 47Y and 47W are kept at 50 PPM as shown in FIG. 4C.

Referring to FIG. 4E, the current value supplied by the power source unit 40 becomes larger at a period between the time T2 and the time T3. The current value supplied by the power source unit 40 becomes smaller after the time T3 than the current value of the period between the time T2 and the time T3.

That is, the driving apparatus of the comparison example is configured to accelerate the rotation speeds of the belt motor 46 and the ID motors 47K, 47C, 47M, 47Y and 47W from 0 to 50 PPM at the same time and in a single step, and therefore peak current applied to these motors becomes large during the period between the time T2 and the time T3. Accordingly, the power source unit 40 with a large capacity is needed, even though a large current value is not needed after the time T3. Accordingly, size and cost of the driving apparatus may increase. Moreover, abrasion between the belt 11 and each image bearing body 22 may increase due to variations in rotational speeds of the belt motor 46 and the drum motors 47K, 47C, 47M, 47Y and 47W. As a result, lifetimes of the belt and the image bearing bodies may be shortened.

For this reason, the driving apparatus of Embodiment 1 of the present invention is configured to disperse a current required for starting and accelerating the belt motor 46 and the ID motors 47K, 47C, 47M, 47Y and 47W so as to reduce the peak current as described below.

[III] Relationship Between Brake Signal and Rotation Speed of Dc Motor

Figures 5A, 5B, 5C, 5D, 5E:
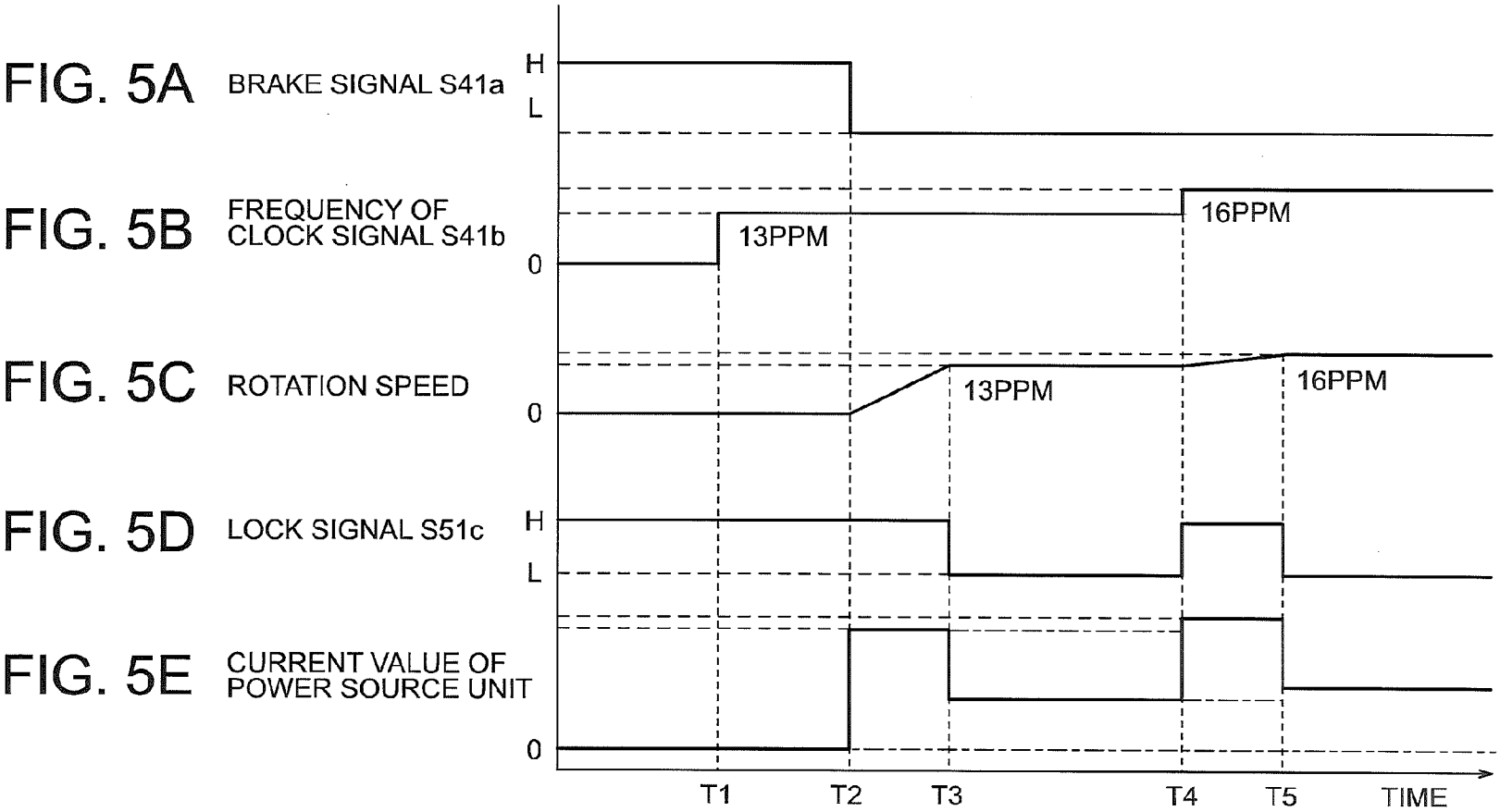
FIGS. 5A, 5B, 5C, 5D and 5E are timing charts respectively showing brake signal, frequency of clock signal, a rotation speed of a DC motor, lock signal and a current value of a power source unit according to Embodiment 1 of the present invention.

FIGS. 5A, 5B, 5C, 5D and 5E are timing charts showing driving timings of the driving apparatus of Embodiment 1. FIG. 5A shows the brake signal S41*a*. FIG. 5B shows the frequency of the clock signal S41*b*. FIG. 5C shows the rotation speeds (PPM) of the belt motor 46 (and the rotation speed of the ID motors 47K, 47C, 47M, 47W and 47W). FIG. 5D shows the lock signal S51*c*. FIG. 5E shows the current value (A) supplied by the power source unit 40.

At a time T1, the frequency of the clock signal S41*b* is switched from 0 to a frequency corresponding to 13 PPM as shown in FIG. 5B, while the brake signal S41*a* is kept at the H-level (FIG. 5A). At a time T2, the brake signal S41*a* is switched from the H-level to the L-level as shown in FIG. 5A. As the brake signal S41*a* is switched from the H-level to the L-level, the rotation speeds of the belt motor 46 and the ID motors 47K, 47C, 47M, 47Y and 47W increase from 0 to 13 PPM as shown in FIG. 5C.

At a time T3, the rotation speed of the DC motor 54 reaches 13 PPM, and the lock signal S51*c* is switched from the H-level to the L-level as shown in FIG. 5D. Thereafter, the frequency of the clock signal S41*b* is kept at the frequency corresponding to 13 PPM, and the rotation speed of the DC motor 54 is kept at 13 PPM as shown in FIG. 5C.

At a time T4, the frequency of the clock signal S41*b* is set to a frequency corresponding to 16 PPM as shown in FIG. 5B. At the same time, the lock signal S51*c* changes from the L-level to the H-level as shown in FIG. 5D. Therefore, the rotation speeds of the belt motor 46 and the ID motors 47K, 47C, 47M, 47Y and 47W increase. The rotation speeds of the belt motor 46 and the ID motors 47K, 47C, 47M, 47Y and 47W reach 16 PPM at a time T5 as shown in FIG. 5C. At the time T5, the lock signal S51*c* changes from the H-level to the L-level as shown in FIG. 5D.

Referring to FIG. 5E, the current value supplied by the power source unit 40 becomes larger at a period between the time T2 and the time T3. However, the current value at this period is smaller than the current value at the same period (i.e., between the time T2 and the time T3) of the comparison example shown in FIG. 4E.

[IV] Driving Timings of Driving Apparatus of Embodiment 1

In the driving apparatus of Embodiment 1, the belt motor 46 and the ID motors 47K, 47C, 47M, 47Y and 47W are grouped into two groups. The two groups are different in timing of switching the brake signal S41*a* from the H-level to the L-level. This is for dispersing the current for starting and accelerating the motors.

In Embodiment 1, the rotation speeds of the belt motor 46 and the ID motors 47K, 47C, 47M, 47Y and 47W are not accelerated to the printing speed in a single step. The frequency of the clock signal S41*b* is changed in a stepwise fashion in order to disperse the current required for starting and acceleration. The belt motor 46 and the ID motors 47K, 47C, 47M, 47Y and 47W are grouped into three groups (i.e., acceleration groups) A, B and C.

The acceleration group A includes the ID motors 47K and 47C. The acceleration group B includes the ID motors 47M and 47Y. The acceleration group C includes the ID motors 47W and the belt motor 46.

The setting speeds of the acceleration groups A, B and C are increased in this order (i.e., in the order of the acceleration groups A, B and C). The setting speed (i.e., the frequency of the clock signal S41*a*) of each group is made higher than the setting speed of the previous group. With such an arrangement, the rotation speeds of the belt 11 and the photosensitive drum 22 of the ID units 20 are accelerated to the printing speed, and a difference between a moving amount of the belt 11 and a moving amount of the photosensitive drum 22 (contacting each other) is reduced.

The control unit 41 has a plurality of setting speeds for the belt motor 46 (and the ID motors 47K, 47C, 47M, 47Y and 47W) so as to correspond to the printing speed according to a type of the recording medium, an environment (i.e., temperature, humidity or the like) or the like.

[V] Driving Method of Embodiment 1

Hereinafter, description will be made of a driving method for starting and accelerating the belt motor 46 (and the ID motors 47K, 47C, 47M, 47Y and 47W) according to Embodiment 1.

The driving method of Embodiment 1 includes first processing to start rotations of the belt motor 46 and the ID motors 47K, 47C, 47M, 47Y and 47W (from the time T1 to the time T3), second processing to detect that the rotation speeds of the belt motor 46 and the ID motors 47K, 47C, 47M, 47Y and 47W reaches a first speed (from the time T2 to the time T4), and third processing to accelerate the rotation speeds of the belt motor 46 and the ID motors 47K, 47C, 47M, 47Y and 47W to a second speed (from the time T4 to a time T14). The first speed and the second speed are also referred to as a first constant speed and a second constant speed.

Figures 6A, 6B, 6C, 6D, 6E, 6F, 6G, 6H, 6I, 6J, 6K, 6L, 6M, 6N, 6O, 6P:
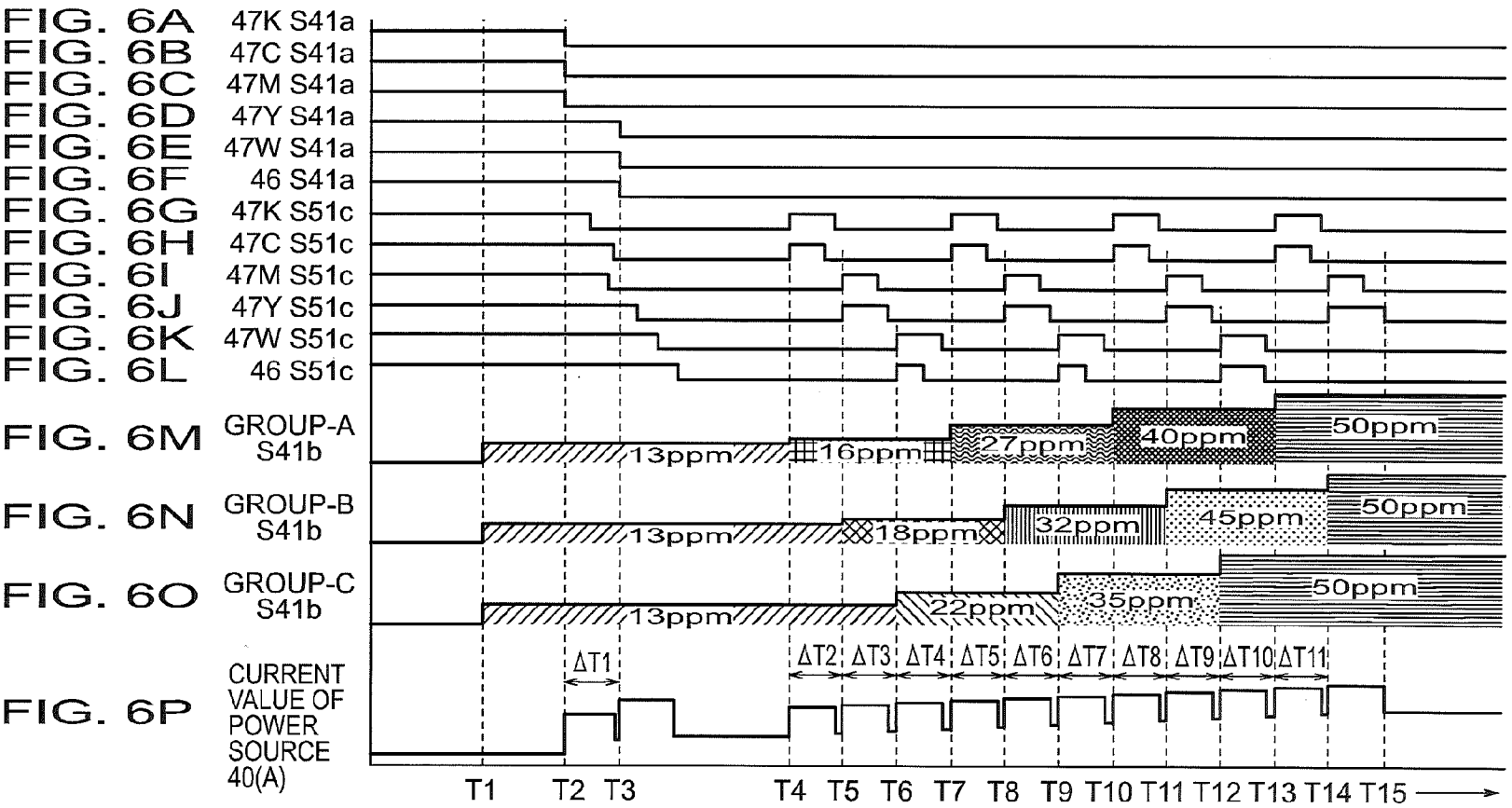
FIGS. 6A through 6P are timing charts showing driving timings of the driving apparatus according to Embodiment 1 of the present invention.

FIGS. 6A through 6P are timing charts showing driving timings of Embodiment 1. FIGS. 6A, 6B, 6C, 6D, 6E and 6F show the brake signals S41*a* for the ID motors 47K, 47C, 47M, 47Y and 47W and the belt motor 46. FIGS. 6G, 6H, 6I, 6J, 6K and 6L show the lock signals S51*c* from the ID motors 47K, 47C, 47M, 47Y and 47W and the belt motor 46. FIG. 6M shows the frequency of the clock signal S41*b* for the acceleration group A (i.e., the ID motors 47K and 47C). FIG. 6N shows the frequency of the clock signal S41*b* for the acceleration group B (i.e., the ID motors 47M and 47Y). FIG. 6O shows the frequency of the clock signal S41*b* for the acceleration group C (i.e., the ID motors 47W and the belt motor 11). FIG. 6P shows the current value (A) supplied by the power source unit 40.

At the time T1, the frequency of the clock signal CK for all motors (i.e., the belt motor 46 and the ID motors 47K, 47C, 47M, 47Y and 47W) is set to a frequency corresponding to 13 PPM (i.e., the first speed) as shown in FIGS. 6M, 6N and 6O. At the time T2, the brake signals S41*a* for the ID motors 47K, 47C and 47M are switched from the H-level to the L-level as shown in FIGS. 6A, 6B and 6C. This causes the ID motors 47K, 47C and 47M to start rotating. When the rotation speeds of the ID motors 47K, 47C and 47M reach 13 PPM, the lock signals S51*c* from the ID motors 47K, 47C and 47M change from the H-level to the L-level as shown in FIGS. 6G, 6H and 6I. In an example shown in FIGS. 6G, 6H and 6I, the lock signal S51*c* changes from the H-level to the L-level in the order of the ID motors 47K, 47M and 47C.

At the time T3 when a predetermined time period ΔT1 (50 ms) has passed after the time T2, the brake signals S41*a* for the ID motors 47Y and 47W and the belt motor 46 are switched from the H-level to the L-level as shown in FIGS. 6D, 6E and 6F. This causes the ID motors 47Y and 47W and the belt motor 46 to start rotating. When the rotation speeds of the ID motors 47Y and 47W and the belt motor 46 reach 13 PPM (i.e., the first speed), the lock signals S51*c* from the ID motors 47Y and 47W and the belt motor 46 change from the H-level to the L-level as shown in FIGS. 6J, 6K and 6L. In this state, the lock signals S51*c* of the ID motors 47K, 47C, 47M, 47Y and 47W and the belt motor 46 are in the L-level. In other words, the control unit 41 detects that the rotation speeds of the ID motors 47K, 47C, 47M, 47Y and 47W and the belt motor 46 reach the first speed (i.e., 13 PPM).

At the time T4, the frequency of the clock signal S41*b* for the acceleration group A (i.e., the ID motors 47K and 47C) is set to a frequency corresponding to 16 PPM (i.e., a first intermediate speed) as shown in FIG. 6M. At a time T5 when a predetermined time period ΔT2 (50 ms) has passed after the time T4, the frequency of the clock signal S41*b* for the acceleration group B (i.e., the ID motors 47M and 47Y) is set to a frequency corresponding to 18 PPM (i.e., a second intermediate speed) as shown in FIG. 6N. At a time T6 when a predetermined time period ΔT3 (50 ms) has passed after the time T5, the frequency of the clock signal S41*b* for the acceleration group C (i.e., the ID motor 47W and the belt motor 46) is set to a frequency corresponding to 22 PPM (i.e., a third intermediate speed) as shown in FIG. 6O.

At a time T7 when a predetermined time period ΔT4 (50 ms) has passed after the time T6, the frequency of the clock signal S41*b* for the acceleration group A (i.e., the ID motors 47K and 47C) is set to a frequency corresponding to 27 PPM (i.e., a fourth intermediate speed) as shown in FIG. 6M. At a time T8 when a predetermined time period ΔT5 (50 ms) has passed after the time T7, the frequency of the clock signal S41*b* for the acceleration group B (i.e., the ID motors 47M and 47Y) is set to a frequency corresponding 32 PPM (i.e., a fifth intermediate speed) as shown in FIG. 6N. At a time T9 when a predetermined time period ΔT6 (50 ms) has passed after the time T8, the frequency of the clock signal S41*b* for the acceleration group C (i.e., the ID motor 47W and the belt motor 46) is set to a frequency corresponding to 35 PPM (i.e., a sixth intermediate speed) as shown in FIG. 6O.

At a time T10 when a predetermined time period ΔT7 (50 ms) has passed after the time T9, the frequency of the clock signal S41*b* for the acceleration group A (i.e., the ID motors 47K and 47C) is set to a frequency corresponding to 40 PPM (i.e., a seventh intermediate speed) as shown in FIG. 6M. At a time T11 when a predetermined time period ΔT8 (50 ms) has passed after the time T10, the frequency of the clock signal S41*b* for the acceleration group B (i.e., the ID motors 47M and 47Y) is set to a frequency corresponding to 45 PPM (i.e., an eighth intermediate speed) as shown in FIG. 6N. At a time T12 when a predetermined time period ΔT9 (50 ms) has passed after the time T11, the frequency of the clock signal S41*b* for the acceleration group C (i.e., the ID motor 47W and the belt motor 46) is set to a frequency corresponding to 50 PPM as shown in FIG. 6O. In this regard, 50 PPM corresponds to the printing speed (i.e., the second speed).

At a time T13 when a predetermined time period ΔT10 (50 ms) has passed after the time T12, the frequency of the clock signal S41*b* for the acceleration group A (i.e., the ID motors 47K and 47C) is set to a frequency corresponding to 50 PPM as shown in FIG. 6M. At a time T14 when a predetermined time period ΔT11 (50 ms) has passed after the time T13, the frequency of the clock signal S41*b* for the acceleration group B (i.e., the ID motors 47M and 47Y) is set to 50 PPM as shown in FIG. 6N. Up to a time T15, the rotation speeds of the ID motors 47K, 47C, 47M, 47Y and 47W and the belt motor 46 reach the printing speed (i.e., the second speed).

In the above description, the time periods ΔT1 through ΔT11 are all set to 50 ms. The time periods ΔT1 through ΔT11 are set so as to be sufficient to accelerate the motors to the setting rotation speeds, and are determined experimentally.

The time period from the time T3 to the time T4 depends on variation in outputs of the motors, loads applied to the motors, and a time required for the control unit 41 to detect the lock signal S51*c*. In this example, the time period from the time T3 to the time T4 is 100 ms. The time period from the time T14 to the time T15 depends on the variation in the outputs of the motors and the loads applied to the motors. In this example, the time period from the time T14 to the time T15 is 50 ms. Therefore, a total time (i.e., from the time T2 to the time T15) after the ID motors 47K, 47C, 47M, 47Y and 47W and the belt motor 46 are started and before the rotation speeds reach 50 PPM (i.e., the printing speed) is 700 ms.

Referring to FIG. 6P showing the current value supplied by the power source unit 40, the peak current value is reduced by dispersing the current required for starting and accelerating the DC motors 54 (controlled by the current limit function). Further, the belt motor 46 and the ID motors 47K, 47C, 47M, 47Y and 47W are grouped into three acceleration groups A, B and C. The setting speeds of the acceleration groups A, B and C are increased in this order (i.e., in the order of the acceleration groups A, B and C). The setting speed of each group is made larger than the setting speed of the previous group. In this way, the rotation speeds of the belt motor 46 and the ID motors 47K, 47C, 47M, 47Y and 47W are accelerated to the printing speed, and a difference between the moving amount of the belt 11 and the moving amount of the photosensitive drum 22 (contacting each other) is reduced.

Advantages of Embodiment 1

According to Embodiment 1 of the present invention, the current required for starting and accelerating the belt motor 46 and the ID motors 47K, 47C, 47M, 47Y and 47W (controlled by the current limit function) are dispersed, and therefore the peak current value can be lowered. Therefore, the power source unit 40 does not need to have a large capacity. Accordingly, the cost and size of the driving apparatus and the image forming apparatus can be reduced. Further, abrasion between the belt 11 and each photosensitive drum 22 (i.e., the image bearing body) can be reduced. As a result, lifetimes of the belt 11 and the photosensitive drum 22 can be lengthened.

Embodiment 2

Configuration of Embodiment 2

Figure 7:
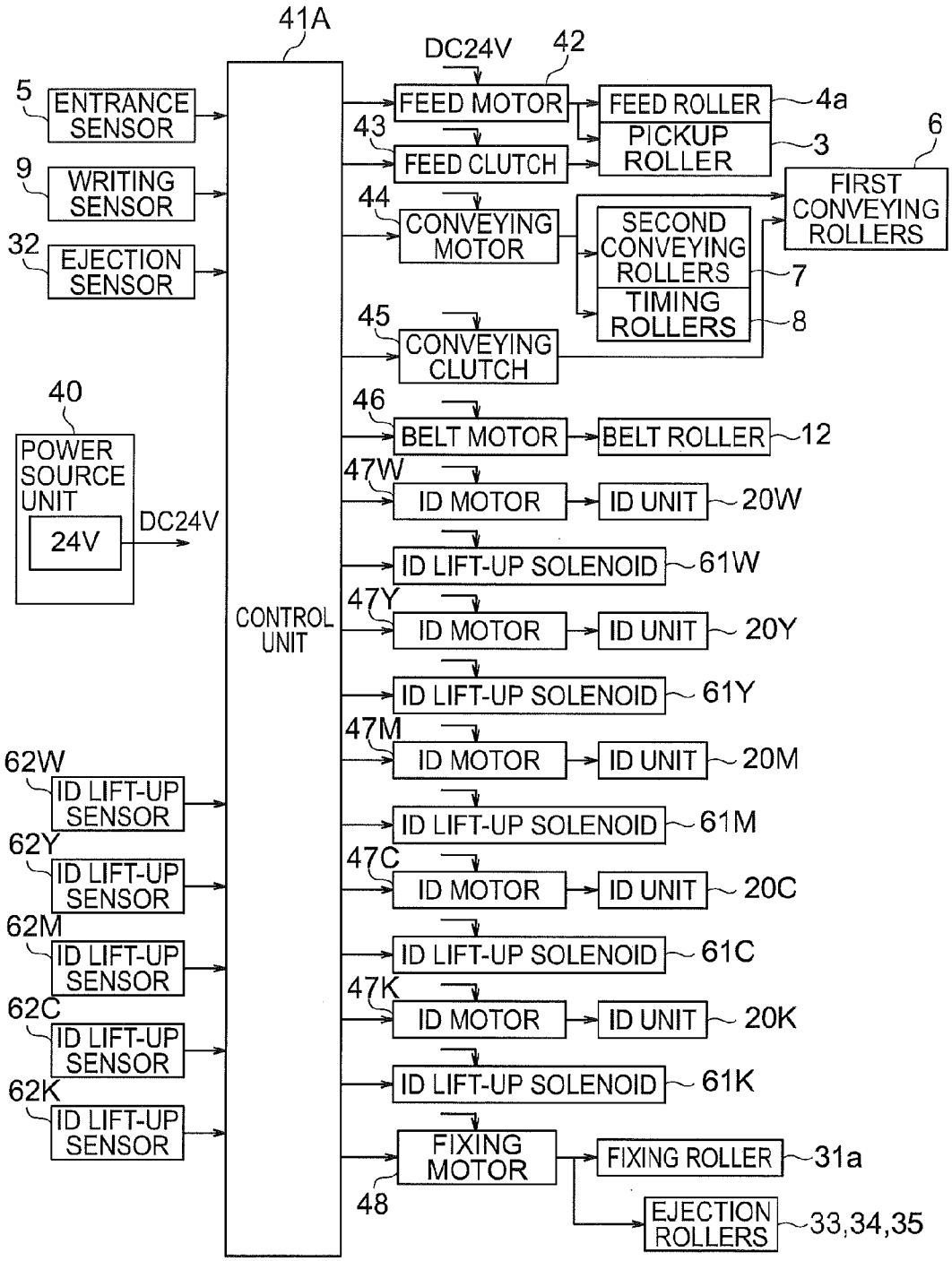
FIG. 7 is a block diagram showing a belt motor of a driving apparatus according to Embodiment 2 of the present invention.

FIG. 7 is a block diagram showing a belt motor 46 of a driving apparatus according to Embodiment 2 of the present invention. Components that are the same as those of Embodiment 1 (FIG. 2) are assigned with the same reference numerals.

The driving apparatus of Embodiment 2 includes a power source unit 40 and a control unit 41A. The power source unit 40 is the same as the power source unit 40 of Embodiment 1. The control unit 41A is different from the control unit 41 of Embodiment 1 in function. The driving apparatus of Embodiment 2 includes an entrance sensor 5, a writing sensor 9 and an ejection sensor 32 connected to the control unit 41A. The entrance sensor 5, the writing sensor 9 and the ejection sensor 32 are the same as those of Embodiment 1. The driving apparatus of Embodiment 2 further includes a feed motor 42, a feed clutch 43, a conveying motor 44, a conveying clutch 45, a belt motor 46, ID motors 47K, 47C, 47M, 47Y and 47W and a fixing motor 48 connected to the control unit 41A. The feed motor 42, the feed clutch 43, the conveying motor 44, the conveying clutch 45, the belt motor 46, the ID motors 47K, 47C, 47M, 47Y and 47W and the fixing motor 48 are the same as those of Embodiment 1.

Further, the driving apparatus includes ID lift-up solenoids 61K, 61C, 61M, 61Y and 61W (i.e., a shifting mechanism) and ID lift-up sensors 62K, 62C, 62M, 62Y and 62W (i.e., a detection unit) which are connected to the control unit 41A. The ID lift-up solenoids 61K, 61C, 61M, 61Y and 61W are collectively referred to as the ID lift-up solenoids 61. The ID lift-up sensors 62K, 62C, 62M, 62Y and 62W are collectively referred to as lift-up sensors 62.

In the driving apparatus of Embodiment 2, each ID unit 20 is movable between a lower position (i.e., an operating position) where the photosensitive drum 22 contacts the belt 11, and an upper position (i.e., a retracted position) where the photosensitive drum 22 is apart from the belt 11. The ID unit 20 which is in use is positioned at the lower position. In contrast, the ID unit 20 which is not in use is positioned at the upper position. The ID unit 20 is moved from the lower position to the upper position by driving the ID motor 47 while the ID lift-up solenoid 61 is in an ON state.

The photosensitive drum 22 of the ID unit 20 which is in use needs to contact the belt 11. However, the photosensitive drum 22 of the ID unit 20 which is not in use does not need to contact the belt 11. Therefore, in Embodiment 2, the ID unit 20 which is not in use is moved apart from the belt 11. With such an arrangement, lifetimes of the ID units 20 (particularly, the photosensitive drums 22) can be lengthened.

The ID lift-up sensor 62 detects whether the ID unit 20 is in the lower position or the upper position, and outputs detection signal. The ID lift-up sensor 62 is constituted by, for example, a photo-interrupter. When the ID unit 20 is in the lower position, the ID lift-up sensor 62 outputs detection signal of the H-level. When the ID unit 20 is in the upper position, the ID lift-up sensor 62 outputs the detection signal of the L-level.

<Operation of Embodiment 2>

Figures 8A, 8B, 8C, 8D, 8E, 8F, 8G, 8H, 8I, 8J, 8K, 8L, 8M, 8N, 8O, 8P, 8Q, 8R, 8S:
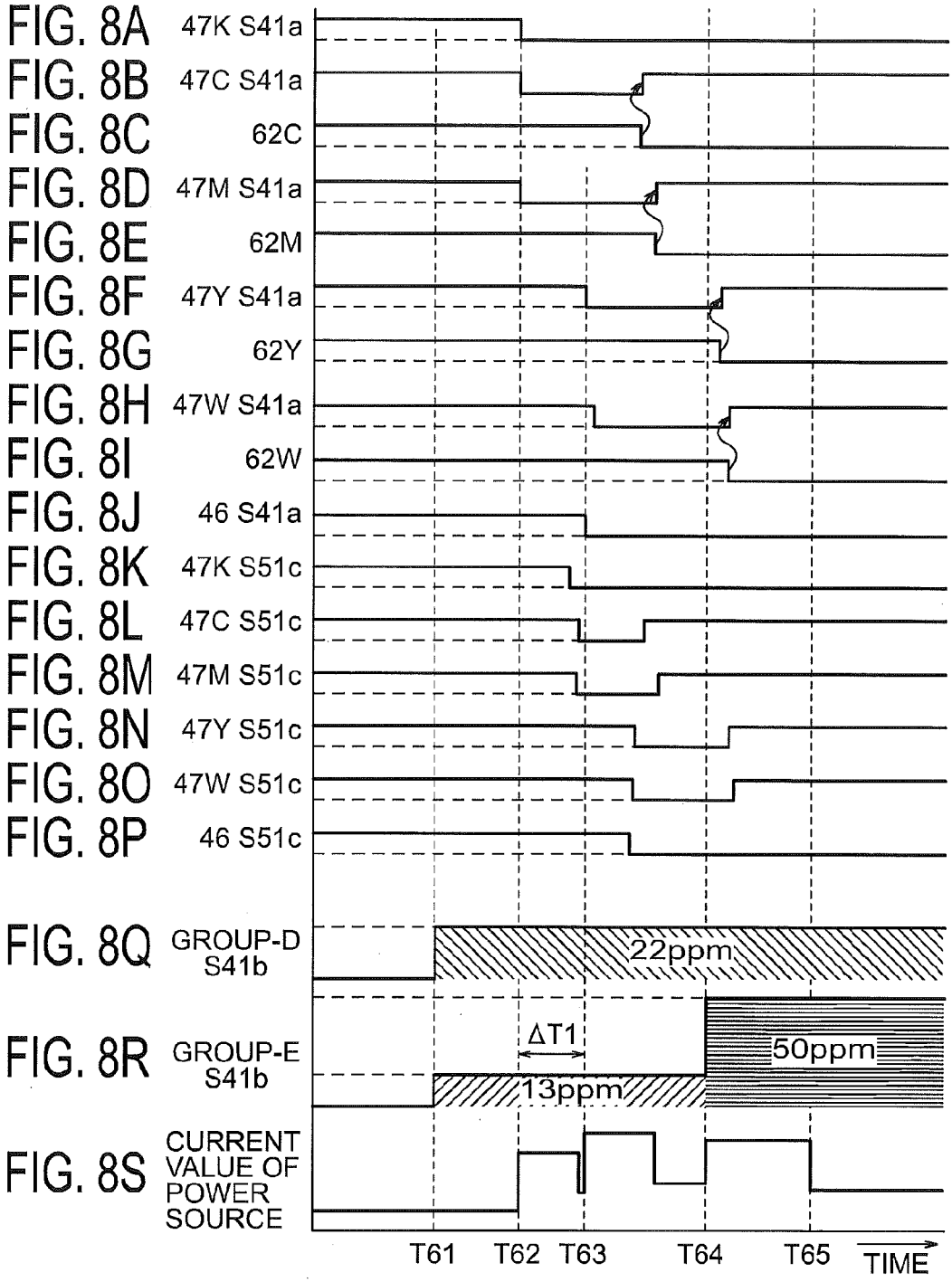
FIGS. 8A through 8S are timing charts showing driving timings of the driving apparatus according to Embodiment 2 of the present invention.

FIGS. 8A through 8S shows a timing chart showing driving timings of the driving apparatus shown in FIG. 7.

In the above described Embodiment 1, the rotation speeds of the ID motors 47K, 47C, 47M, 47Y and 47W (used in color printing) are increased in a stepwise fashion, and therefore it takes time until the printing speed (i.e., 50 PPM) is reached. Therefore, it takes time to complete printing of, for example, a first page. In Embodiment 2, acceleration from the first speed (i.e., 13 PPM) to the second speed (i.e., 50 PPM) is performed in a single step in a monochrome printing operation. Hereinafter, description will be made of a driving method for starting and accelerating the belt motor 46 (and the ID motor 47K) in the monochrome printing operation.

FIGS. 8A and 8B show the brake signals S41*a* for the ID motors 47K and 47C. FIG. 8C shows the detection signal from the lift-up sensor 62C. FIG. 8D shows the brake signal S41*a* for the ID motor 47M. FIG. 8E shows the detection signal from the lift-up sensor 62M. FIG. 8F shows the brake signal S41*a* for the ID motor 47Y. FIG. 8G shows the detection signal from the lift-up sensor 62Y. FIG. 8H shows the brake signal S41*a* for the ID motor 47W. FIG. 8I shows the detection signal from the lift-up sensor 62W. FIG. 8J shows the brake signal S41*a* for the belt motor 46. FIGS. 8K, 8L, 8M, 8N, 8O and 8P show the lock signals S51*c* from the ID motors 47K, 47C, 47M, 47Y and 47W. FIG. 8Q shows the frequency of the clock signal S41*b* for the acceleration group D (i.e., the ID motors 47C, 47M, 47Y and 47W). FIG. 8R shows the frequency of the clock signal S41*b* for the acceleration group E (i.e., the ID motor 47K and the belt motor 46). FIG. 8S shows the current value (A) supplied by the power source unit 40.

In the monochrome printing operation, the belt motor 46 and the ID motor 47K are used, but the ID motors 47C, 47M, 47Y and 47W are not used. Therefore, the peak current is relatively low. Therefore, in Embodiment 2, the belt motor 46 and the ID motor 47K are grouped into the acceleration group D. The ID motors 47C, 47M, 47Y and 47W are grouped into the acceleration group E. In the monochrome printing operation, the control unit 41*a* accelerates the rotation speeds of the belt motor 46 and the ID motor 47K (i.e., the acceleration group E) to from the first speed to the second speed (i.e., the printing speed) in a single step. Further, in the monochrome printing operation, the ID motors 47C, 47M, 47Y and 47W (i.e., the acceleration group D) are used to drive the ID lift-up solenoids 61C, 61M, 61Y and 61W to lift up the ID units 20C, 20M, 20Y and 20W to the upper position.

At a time T61, the frequency of the clock signal S41*b* for the motors 47C, 47M, 47Y and 47W (used to lift up the ID units 20C, 20M, 20Y and 20W) is set to a frequency corresponding to 22 PPM as shown in FIG. 8Q. Further, the frequency of the clock signal S41*b* for the other motors is set to a frequency corresponding to 13 PPM (i.e., the first speed) as shown in FIG. 8R.

At a time T62, the brake signals S41*a* for the ID motors 47K, 47C and 47M are switched from the H-level to the L-level as shown in FIGS. 8A, 8B and 8D. This causes the ID motors 47K, 47C and 47M to start rotating. When the rotation speed of the ID motor 47K reaches 13 PPM, and the ID motors 47C and 47M reach 22 PPM, the lock signals S51*c* change from the H-level to the L-level as shown in FIGS. 8K, 8L and 8M. Further, when the ID units 20C and 20M are lifted to the upper position, detection signals S62C and S62M from the ID lift-up sensors 62C and 62M change from the H-level to the L-level as shown in FIGS. 8C and 8E.

At a time T63 when a predetermined time period ΔT1 (50 ms) has passed after the time T62, the brake signals S41*a* for the ID motor 47Y and 47W and the belt motor 46 are set to the L-level as shown in FIGS. 8F, 8H and 8J. This causes the ID motors 47Y and 47W and the belt motor 46 to start rotating. When the rotation speeds of the ID motors 47Y and 47W and the belt motor 46 reach 13 PPM, the lock signals S51*c* from the ID motors 47Y and 47W and the belt motor 46 change from the H-level to the L-level as shown in FIGS. 8N, 8O and 8P. Further, when the ID units 20Y and 20W are lifted to the upper position, detection signals S62Y and S62W from the ID lift-up sensors 62Y and 62W change from the H-level to the L-level as shown in FIGS. 8G and 8I.

At a time T64, the lock signals S51*c* from the ID motor 47K and the belt motor 46 change from the H-level to the L-level as shown in FIGS. 8K, 8L and 8M. That is, the control unit 41 detects that the rotation speeds of the ID motor 47K and the belt motor 46 reach 13 PPM (i.e., the first speed). Then, the frequency of the clock signal S41*b* for the ID motor 47K and the belt motor 46 (i.e., the acceleration group E) is set to 50 PPM (i.e., the printing speed) as shown in FIG. 8R. Up to a time T65, the rotation speeds of the ID motor 47K and the belt motor 46 reach the printing speed.

The time period ΔT1 between the time T62 and the time T63 is set to be sufficient to accelerate the rotation speeds of the ID motor 47K and the belt motor 46 to the setting speed, and is determined experimentally. In this example, the time period ΔT1 is 100 ms.

The time period between the time T64 and the time T65 depends on variation in outputs of the motors (i.e., the ID motor 47K and the belt motor 46) and loads applied to the motors. In this example, the time period between the time T64 and the time T65 is 50 ms. Therefore, a total time (i.e., from the time T62 to the time T65) after the ID motors 47K, 47C, 47M, 47Y and 47W and the belt motor 46 are started and before the rotation speeds of the ID motor 47K and the belt motor 46 reach the printing speed is 200 ms.

In this way, current for starting and accelerating the DC motor 54 (by current limitation) are distributed, and therefore the peak current can be reduced.

In a color printing operation (in which the ID units 20K, 20C, 20M, 20Y and 20W are used to form an image), the driving method is the same as the driving method described in Embodiment 1.

Advantages of Embodiment 2

According to Embodiment 2 of the present invention, when printing is performed using a reduced number of motors (for example, in the monochrome printing operation), the acceleration of the rotation speeds of the motors (i.e., the ID motor 47K and the feed motor 46) from the first speed to the second speed (i.e., the printing speed) is performed at a single step. Therefore, a time for acceleration to the printing speed can be shortened. Accordingly, for example, a time for completing the printing of a first page can be shortened. Further, since the ID units 20C, 20M, 20Y and 20W which are not in use in the monochrome printing are kept apart from the belt 11, abrasion of the photosensitive drums 22 (i.e., the image bearing bodies) and the belt 11 can be reduced. Therefore, the lifetimes of the replaceable parts (i.e., the ID units 20) can be lengthened.

Embodiment 3

Configuration of Embodiment 3

Figure 9:
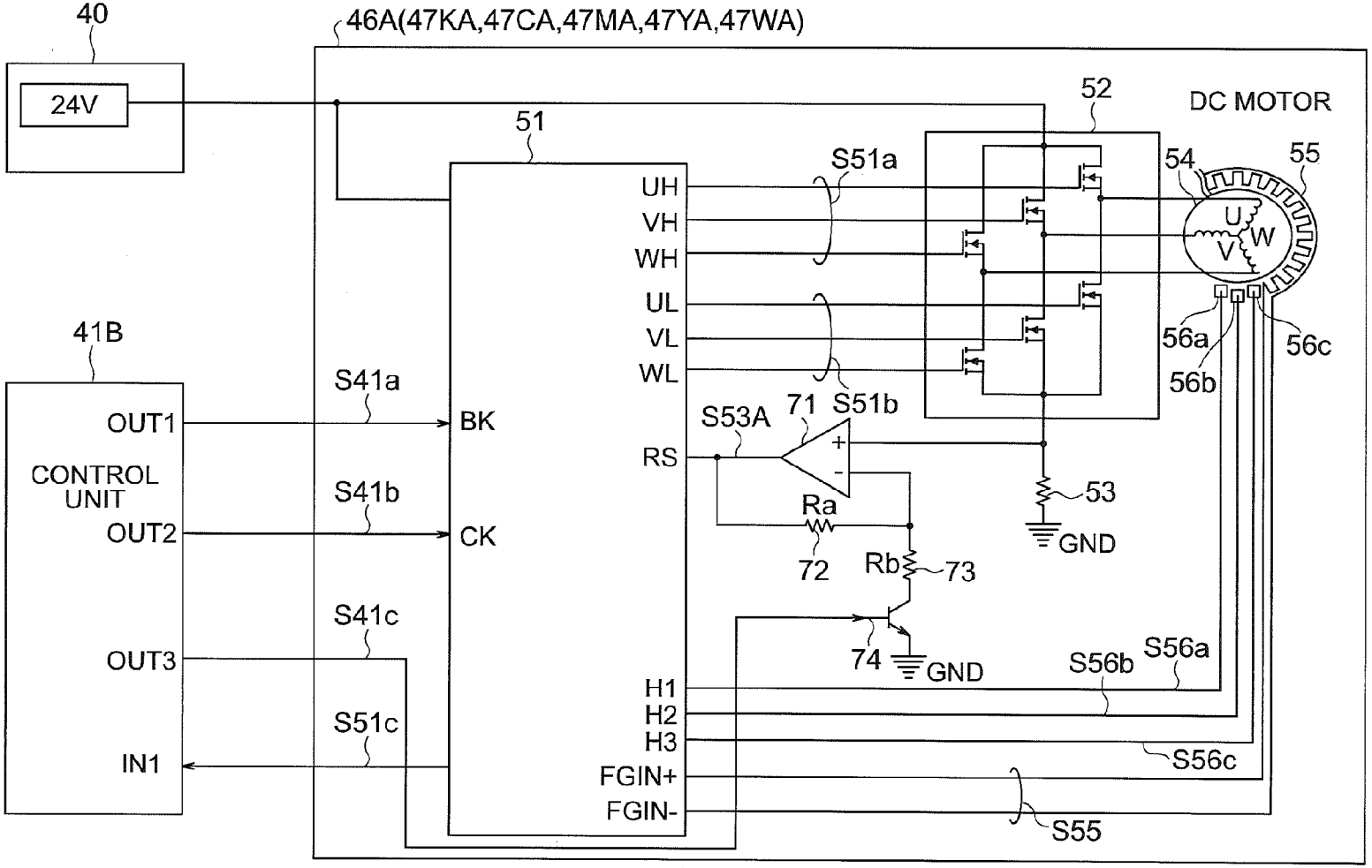
FIG. 9 is a block diagram showing a belt motor of a driving apparatus according to Embodiment 3 of the present invention.

FIG. 9 is a block diagram showing a belt motor 46A of Embodiment 3 of the present invention. Components that are the same as those of Embodiment 1 (FIG. 3) are assigned with the same reference numerals.

The belt motor 46A and ID motors 47KA, 47CA, 47MA, 47YA and 47WA (collectively referred to as the ID motors 47A) have the same configurations. Therefore, the configurations of the belt motor 46A and ID motors 47KA, 47CA, 47MA, 47YA and 47WA will be described taking an example of the belt motor 46A. It is also possible that the fixing motor 48 has the same configuration as that shown in FIG. 9.

The control unit 41B has an output port OUT3, and outputs gain signal S41*c* from the output port OUT3. The outputted gain signal S41*c* is inputted into a base terminal of a transistor 74 of the belt motor 46A. An emitter terminal of the transistor 74 is grounded. A collector terminal of the transistor 74 is connected to a resistance 73 having a resistance value Rb. The resistance 73 having the resistance value Rb is connected to a resistance 72 having a resistance value Ra, and is also connected to an inverting amplifier terminal of an operational amplifier 71. A source terminal of low-side FETs 52*d*, 52*e* and 52*f* of a power MOSFET array 52 is grounded via a current detection resistance 53. Current detection signal S53 from the current detection resistance 53 is inputted into a non-inverting amplifier terminal of the operational amplifier 71. An output terminal of the operational amplifier 71 is connected to the resistance 72 having the resistance value Ra, and is also connected to a reset terminal RS of the motor control IC 51. Current detection signal S53A is outputted from the operation amplifier 71 and is inputted into the reset terminal RS of the motor control IC 51.

The motor control IC 51 has a circuit having a current limit function to bring the high-side FETs 52*a*, 52*b* and 52*c* to an OFF state when the current detection signal S53A becomes greater than a threshold (for example, 0.25V). While the DC motor 54 is started and accelerated, a current limit value is maintained by the current limit function. After the DC motor 54 reaches a predetermined rotation speed, the current value decreases.

When the gain signal S41*c* from the control unit 41B is the L-level, the transistor 74 is in the OFF state. In this case, the operational amplifier 71 acts as a voltage follower, and a gain of the operational amplifier 71 is 1. When the gain signal S41*c* is the H-level, the transistor 74 is in the ON state. In this case, the gain of the operation amplifier 71 is (Ra+Rb)/Rb. For example, when the resistance value Ra is 1 kΩ and the resistance value Rb is 2 kΩ, a voltage of the current detection resistance 53 is multiplied by 1.5. The multiplied voltage (i.e., current detection signal S53A) is inputted into the reset terminal RS of the motor control IC 51. In other words, the current limit value decreases, and the starting current decreases. In this regard, the driving apparatus of Embodiment 3 is configured so that the belt motor 46A (and the ID motors 47KA, 47CA, 47MA, 47YA and 47WA) can rotate with a relatively small current when the rotation speed is lower than or equal to 22 PPM. The operational amplifier 71, the resistances 72 and 73 and the transistor 74 constitute a switching unit that switches the current limit value.

<Operation of Embodiment 3>

Figure 10:
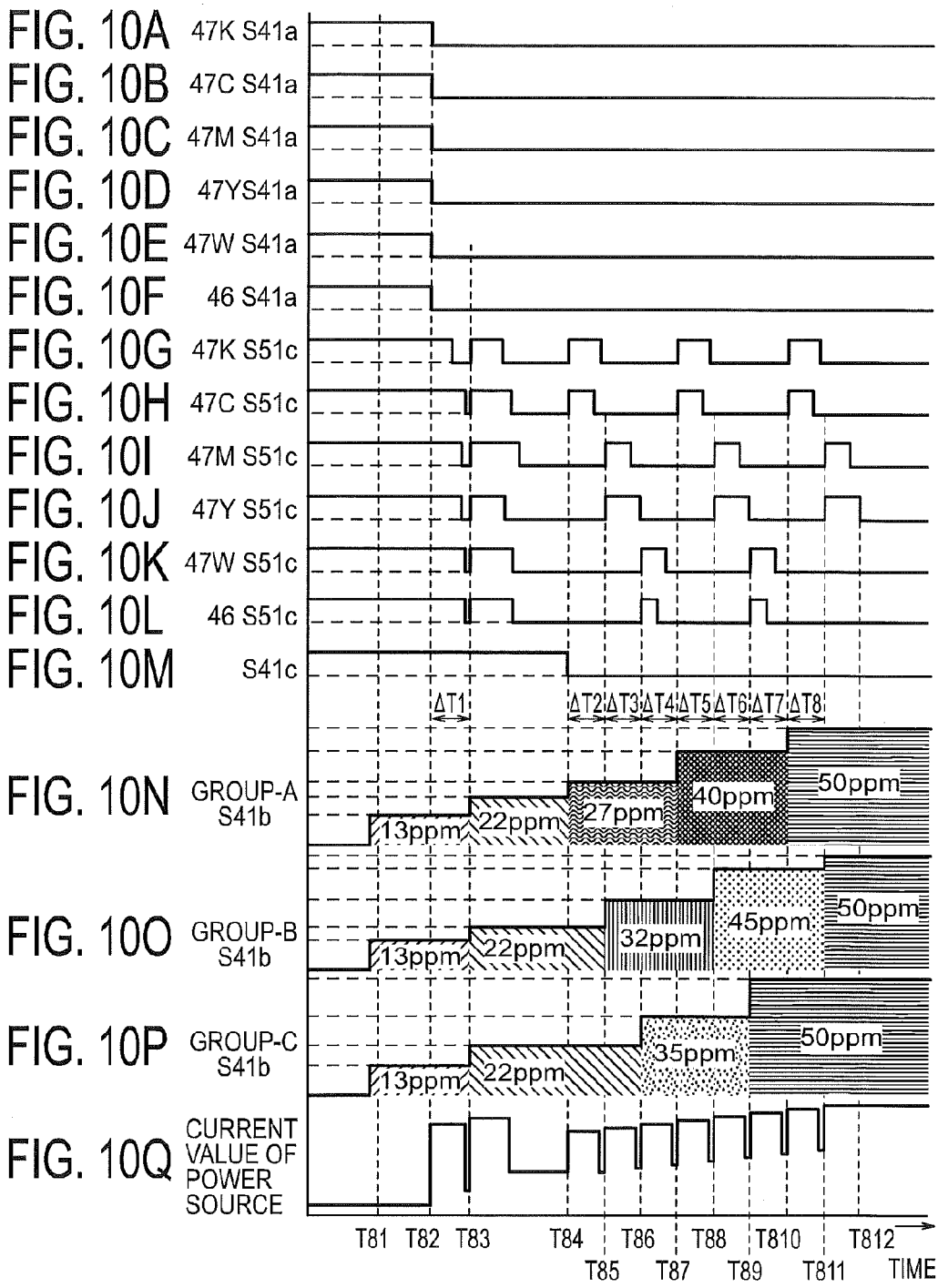
FIGS. 10A through 10Q are timing charts showing driving timings of the driving apparatus according to Embodiment 3 of the present invention.

FIGS. 10A through 10Q are timing charts showing driving timings of Embodiment 3. The belt motor 46A and the ID motors 47KA, 47CA, 47MA, 47YA and 47WA can rotate with a small starting current, and therefore the belt motor 46A and the ID motors 47KA, 47CA, 47MA, 47YA and 47WA are started at the same time.

Further, the rotation speed of the belt motor 46A and the ID motors 47KA, 47CA, 47MA, 47YA and 47WA are accelerated in a stepwise fashion to the printing speed so as to distribute the current. The belt motor 46A and the ID motors 47KA, 47CA, 47MA, 47YA and 47WA are grouped into three groups (i.e., acceleration groups) A, B and C.

The acceleration group A includes the ID motors 47KA and 47CA. The acceleration group B includes the ID motors 47MA and 47YA. The acceleration group C includes the ID motors 47WA and the belt motor 46A.

The setting speeds of the acceleration groups A, B and C are increased in this order (i.e., in the order of the acceleration groups A, B and C). The setting speed (i.e., the frequency of the clock signal S41*a*) of each group is made higher than the setting speed of the previous group.

Hereinafter, description will be made of a driving method for starting and accelerating the belt motor 46A (and the ID motors 47WA, 47YA, 47MA, 47CA and 47KA) according to Embodiment 3.

FIGS. 10A, 10B, 10C, 10D, 10E and 10F show the brake signals S41*a* for ID motors 47KA, 47CA, 47MA, 47YA and 47WA and the belt motor 46A. FIGS. 10G, 10H, 10I, 10J, 10K and 10L show the lock signals S51*c* from ID motors 47KA, 47CA, 47MA, 47YA and 47WA and the belt motor 46A. FIG. 10M shows the gain signal S41*c*. FIG. 10N shows the frequency of the clock signal S41*b* for the acceleration group A (i.e., the ID motors 47KA and 47CA). FIG. 10O shows the frequency of the clock signal S41*b* for the acceleration group B (i.e., the ID motors 47MA and 47YA). FIG. 10P shows the frequency of the clock signal S41*b* for the acceleration group C (i.e., the ID motors 47WA and the belt motor 46A). FIG. 10Q shows the current value (A) supplied by the power source unit 40.

At a time T81, the frequency of the clock signal S41*b* for the ID motors 47KA, 47CA, 47MA, 47YA and 47WA and the belt motor 46A is set to a frequency corresponding to 13 PPM (i.e., a first speed) as shown in FIGS. 10N, 10O and 10P. In this state, the gain signal S41*c* is in the H-level as shown in FIG. 10M.

At a time T82, the brake signals S41*a* for the ID motors 47KA, 47CA, 47MA, 47YA and 47WA and the belt motor 46A are switched from the H-level to the L-level as shown in FIGS. 10A through 10F. This causes the ID motors 47KA, 47CA, 47MA, 47YA and 47WA and the belt motor 46A to start rotating. When the rotation speed of the ID motors 47KA, 47CA, 47MA, 47YA and 47WA and the belt motor 46A reaches 13 PPM, the lock signals S51*c* from the ID motors 47KA, 47CA, 47MA, 47YA and 47WA and the belt motor 46A change from the H-level to the L-level as shown in FIGS. 10G through 10L.

At a time T83 when a predetermined time period ΔT1 (50 ms) has passed after the timing T82, the frequency of the clock signal S41*b* for the ID motors 47KA, 47CA, 47MA, 47YA and 47WA and the belt motor 46A are set to a frequency corresponding to 22 PPM (i.e., a first speed) as shown in FIGS. 10N, 10O and 10P. When the rotation speed of the ID motors 47KA, 47CA, 47MA, 47YA and 47WA and the belt motor 46A reaches 22 PPM, the lock signals S51*c* from the ID motors 47KA, 47CA, 47MA, 47YA and 47WA and the belt motor 46A change from the H-level to the L-level as shown in FIGS. 10G through 10L.

At a time T84, the lock signals S51*c* from the ID motors 47KA, 47CA, 47MA, 47YA and 47WA and the belt motor 46A are in the L-level. In other words, the control unit 41B detects that the rotation speeds of the ID motor 47KA, 47CA, 47MA, 47YA and 47WA and the belt motor 46A reach 22 PPM (i.e., the first speed). Thereafter, the frequency of the clock signal S41*b* for the ID motors 47KA and 47CA (i.e., the acceleration group A) is set to a frequency corresponding to 27 PPM (i.e., a first intermediate speed) as shown in FIG. 10N. At the same time, the gain signal S41*c* changes from the H-level to the L-level, so that the current limit function becomes responsive to the higher rotation speed.

At a time T85 when a predetermined time period ΔT2 (50 ms) has passed after the timing T84, the frequency of the clock signal S41*b* for the ID motors 47MA and 47YA (i.e., the acceleration group B) is set to a frequency corresponding to 32 PPM (i.e., a second intermediate speed) as shown in FIG. 10O. At a time T86 when a predetermined time period ΔT2 (50 ms) has passed after the timing T85, the frequency of the clock signal S41*b* for the ID motor 47WA and the belt motor 46A (i.e., the acceleration group C) is set to a frequency corresponding to 35 PPM (i.e., a third intermediate speed) as shown in FIG. 10P.

At a time T87 when a predetermined time period ΔT4 (50 ms) has passed after the timing T86, the frequency of the clock signal S41*b* for the ID motors 47KA and 47CA (i.e., the acceleration group A) is set to a frequency corresponding to 40 PPM (i.e., a fourth intermediate speed) as shown in FIG. 10N. At a time T88 when a predetermined time period ΔT5 (50 ms) has passed after the timing T87, the frequency of the clock signal S41*b* for the ID motors 47MA and 47YA (i.e., the acceleration group B) is set to a frequency corresponding to 45 PPM (i.e., a fifth intermediate speed) as shown in FIG. 10O. At a time T89 when a predetermined time period ΔT6 (50 ms) has passed after the timing T88, the frequency of the clock signal S41*b* for the ID motor 47WA and the belt motor 46A (i.e., the acceleration group C) is set to a frequency corresponding to 50 PPM as shown in FIG. 10P. In this regard, 50 PPM is the printing speed (i.e., a second speed) in Embodiment 3.

At a time T810 when a predetermined time period ΔT7 (50 ms) has passed after the timing T89, the frequency of the clock signal S41*b* for the ID motors 47KA and 47CA (i.e., the acceleration group A) is set to a frequency corresponding to 50 PPM (i.e., the printing speed) as shown in FIG. 10N. At a time T811 when a predetermined time period ΔT8 (50 ms) has passed after the timing T810, the frequency of the clock signal S41*b* for the ID motors 47MA and 47YA (i.e., the acceleration group B) is set to a frequency corresponding to 50 PPM (i.e., the printing speed) as shown in FIG. 10O. Up to a time T812, the rotation speed of the ID motors 47KA, 47CA, 47MA, 47YA and 47WA and the belt motor 46A reaches 50 PPM (i.e., the printing speed).

The predetermined time periods ΔT1 through £T8 are set so as to be sufficient to accelerate the respective motors to the setting rotation speeds, and are experimentally determined.

The time period from the time T83 to the time T84 depends on variation in outputs of the motors, loads applied to the motors, and a time required for the control unit 41 to detect the lock signal S51*c*. In this example, the time period from the time T83 to the time T84 is 100 ms. The time period from the time T811 to the time T812 depends on the variation in the outputs of the motors and the loads applied to the motors. In this example, the time period from the time T811 to the time T812 is 50 ms. Therefore, a total time (i.e., from the time T82 to the time T812) after the ID motors 47K, 47C, 47M, 47Y and 47W and the belt motor 46 are started and before the rotation speeds reach 50 PPM (i.e., the printing speed) is 550 ms.

Referring to FIG. 10Q, the peak current value is reduced by dispersing the current required for starting and accelerating the DC motors 54 (controlled by the current limit function). Further, the belt motor 46A and the ID motors 47KA, 47CA, 47MA, 47KA and 47WA are grouped into three groups A, B and C. The setting speeds of the acceleration groups A, B and C are increased in this order (i.e., in the order of the acceleration groups A, B and C). The setting speed of each group is made larger than the setting speed of the previous group. In this way, the rotation speeds of the belt motor 46A and the ID motors 47KA, 47CA, 47MA, 47YA and 47WA are accelerated to the printing speed, and a difference between the moving amount of the belt 11 and the moving amount of the photosensitive drum 22 (contacting each other) is reduced. Therefore, lifetimes of the belt 11 and the ID units 20 can be lengthened.

Further, a current value at which the current limit function (required to set the rotation speeds) starts to operate is switched between the starting and acceleration of the motors. Therefore, the number of motors that can be started and accelerated at the same time can be increased. As a result, the printing speed can be reached in a short time period.

Advantages of Embodiment 3

According to Embodiment 3 of the present invention, the driving apparatus is provided with a switching unit (i.e., the operational amplifier 71, the resistances 72 and 73, and the transistor 74) for switching the current value at which the current limit function starts to operate. Therefore, the number of motors that can be started and accelerated at the same time can be increased. Accordingly, the printing speed can be reached in a short time period.

MODIFICATIONS

The present invention is not limited to the above described Embodiments 1 through 3, but modifications and improvements may be made thereto.

For example, the driving apparatuses of Embodiments 1 through 3 are applied to the image forming apparatus of the intermediate transfer type. However, the driving apparatuses described in Embodiments 1 through 3 are applicable to an image forming apparatus of a direct transfer type.

Figure 11:
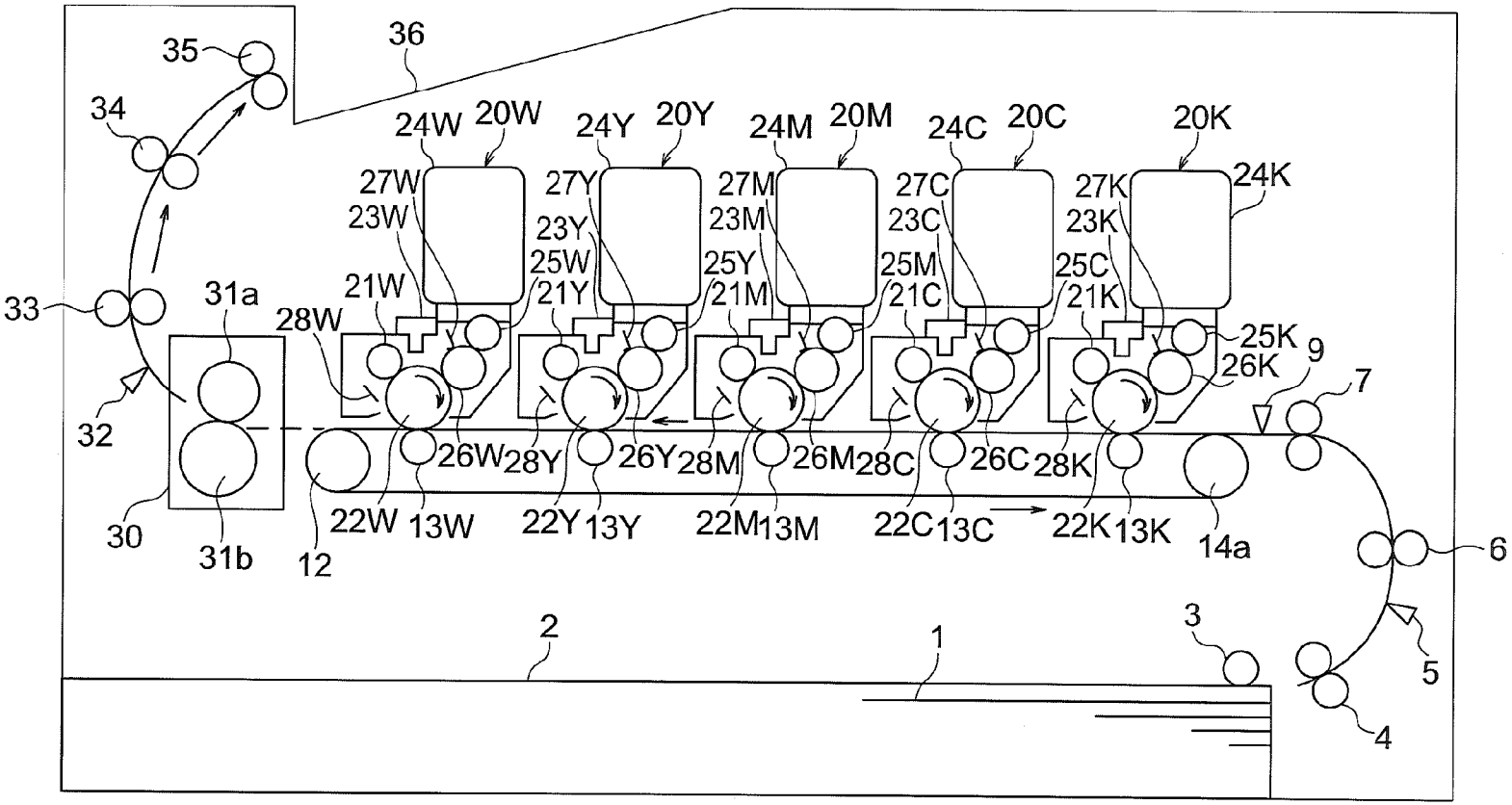
FIG. 11 is a schematic sectional view showing an example of an image forming apparatus of a direct transfer type.

FIG. 11 shows an example of an image forming apparatus of the direct transfer type to which the driving apparatus of Embodiments 1, 2 and 3 can be applied. In FIG. 11, the rotating direction of the belt 11 is opposite to that shown in FIG. 1. The recording medium 1 is conveyed by the belt 11, and passes a nip portion between the photosensitive drum 22K and the transfer roller 13K, a nip portion between the photosensitive drum 22C and the transfer roller 13C, a nip portion between the photosensitive drum 22M and the transfer roller 13M, and a nip portion between the photosensitive drum 22W and the transfer belt 13W in this order. In the image forming apparatus of FIG. 11, for example, the rotation speed of the ID motor 47W of the ID unit 20W on a downstream end in the feeding direction of the recording medium 1 is first accelerated to the second speed. Then, the rotation speeds of the ID motor 47Y of the ID unit 20Y, the ID motor 47M of the ID unit 20M, the ID motor 47C of the ID unit 20C and the ID motor 47K of the ID unit 20K are successively accelerated to the second speed in this order.

In Embodiments 1 and 3, the belt motor 46 (46A) and the ID motors 47K, 47C, 47M, 47Y and 47W (47KA, 47CA, 47MA, 47YA and 47WA) are grouped into 3 groups. In Embodiment 2, the belt motor 46 and the ID motors 47K, 47C, 47M, 47Y and 47W are grouped into 2 groups. However, the number of groups is not limited to 2 or 3, but can be arbitrarily determined based on, for example, the number of the ID units 20 contacting the belt 11.

The driving apparatuses of Embodiments 1 through 3 are employed in the image forming apparatus in the form of a printer. However, the driving apparatus of the present invention is applicable to, for example, a MFP (Multi-Function Peripheral), a copier, a facsimile machine or the like.

While the preferred embodiments of the present invention have been illustrated in detail, it should be apparent that modifications and improvements may be made to the invention without departing from the spirit and scope of the invention as described in the following claims.

What is claimed is:

1. A driving apparatus comprising: a plurality of image bearing bodies each of which is rotatable and capable of bearing a latent image and a developer image; a belt provided so as to face the image bearing bodies, the belt being rotatable; a plurality of image-bearing-body-driving units for rotating the image bearing bodies; a belt driving unit for rotating the belt; and a control unit for controlling the image-bearing-body-driving units and the belt driving unit, wherein the control unit causes the image-bearing-body-driving units and the belt driving unit to start rotating the image bearing bodies and the belt so that the image bearing bodies and the belt rotate at a first speed, wherein when the control unit detects that the image bearing bodies and the belt rotate at the first speed, the control unit causes the image-bearing-body-driving units and the belt driving unit to accelerate rotation speeds of the image bearing bodies and the belt to a second speed faster than the first speed; and wherein the control unit sets an intermediate speed faster than the first speed and slower than the second speed, while the control unit causes the image-bearing-body-driving units and the belt driving unit to accelerate rotation speeds of the image bearing bodies and the belt to the second speed; wherein the intermediate speed includes a first intermediate speed for at least one of the image-bearing-body-driving units and a second intermediate speed for the belt which is different from the first intermediate speed, and wherein the control unit sets the first intermediate speed and the second intermediate speed at different times.

2. The driving apparatus according to claim 1, wherein the control unit groups the image-bearing-body-driving units and the belt driving unit into a plurality of groups, and causes the respective groups to start at different timings, wherein when the number of the image bearing bodies of the group to be accelerated to the second speed is less than or equal to a predetermined number, the control unit does not set the intermediate speed.

3. The driving apparatus according to claim 1, wherein the image-bearing-body driving units and the belt driving units comprise motors;

wherein the driving apparatus further comprises a switching unit that switches current limit values applied to the motors, wherein the control unit causes the switching unit to switch the current limit values, when the image-bearing-body-driving units and the belt driving unit to accelerate the rotation speeds of the image bearing bodies and the belt to the first speed, the intermediate speed or the second speed.

4. The driving apparatus according to claim 1, wherein the control unit groups the image-bearing-body-driving units and the belt driving unit into a plurality of groups including a first group and a second group, and wherein when the control unit detects that the first group reaches the first speed, the control unit causes the first group to start accelerating to a first intermediate speed faster than the first speed, and then when the control unit detects that the second group reaches the first speed, the control unit causes the second group to start accelerating to a second intermediate speed faster than the first intermediate speed.

5. The driving apparatus according to claim 4, wherein after the control unit causes the second group to start accelerating to the second intermediate speed, the control unit causes the first group to start accelerating to a third intermediate speed faster than the second intermediate speed.

6. The driving apparatus according to claim 4, wherein the belt carries the developer image transferred from the image bearing bodies, or carries a recording medium to which the developer image is transferred from the image bearing bodies.

7. An image forming apparatus comprising:

the driving apparatus according to claim 2;

developing units configured to form developer images on the image bearing bodies;

transfer units configured to transfer the developer images from the image bearing bodies to a recording medium directly or via the belt; and a fixing unit that fixes the developer image to the recording medium.

8. The driving apparatus according to claim 4, wherein the control unit groups the image-bearing-body-driving units and the belt driving unit into a plurality of groups, and causes the respective groups to start at different timings.

9. A driving method using a driving apparatus:

the driving apparatus comprising:

a plurality of image bearing bodies each of which is rotatable and capable of bearing a latent image and a developer image;

a belt provided so as to face the image bearing bodies, the belt being rotatable;

a plurality of image-bearing-body-driving units for rotating the image bearing bodies;

a belt driving unit for rotating the belt; and a control unit for controlling the image-bearing-body-driving units and the belt driving unit, wherein the image-bearing-body-driving units and the belt driving unit are grouped into a plurality of groups including a first group and a second group, the driving method comprising:

starting at least one of the image-bearing-body driving units and the belt driving unit so that the image bearing bodies and the belt rotate at a first speed;

detecting that the first group reaches the first speed;

causing the first group to start accelerating to a first intermediate speed faster than the first speed;

detecting that the second group reaches the first speed; and causing the second group to start accelerating to a second intermediate speed faster than the first intermediate speed.

10. An image forming method using an image forming apparatus:

the image forming apparatus comprising:

a plurality of image bearing bodies each of which is rotatable and capable of bearing a latent image and a developer image;

a belt provided so as to face the image bearing bodies, the belt being rotatable, the belt carrying the developer image transferred from the image bearing bodies, or carrying a recording medium to which the developer image is transferred from the image bearing bodies;

a plurality of image-bearing-body-driving units for rotating the image bearing bodies;

a belt driving unit for rotating the belt;

a control unit for controlling the image-bearing-body-driving units and the belt driving unit;

developing units configured to form developer images on the image bearing bodies;

transfer units configured to transfer the developer images from the image bearing bodies to a recording medium directly or via the belt; and a fixing unit that fixes the developer image to the recording medium, wherein the image-bearing-body-driving units and the belt driving unit are grouped into a plurality of groups including a first group and a second group, the image forming method comprising:

starting at least one of the image-bearing-body driving units and the belt driving unit so that the image bearing bodies and the belt rotate at a first speed;

detecting whether the image bearing bodies and the belt rotate at the first speed;

detecting that the first group reaches the first speed;

causing the first group to start accelerating to a first intermediate speed faster than the first speed;

detecting that the second group reaches the first speed;

causing the second group to start accelerating to a second intermediate speed faster than the first intermediate speed;

forming developer images on the image bearing bodies;

transferring the developer images from the image bearing bodies to the recording medium; and fixing the developer images to the recording medium.

* * * * *